US009988233B2

(12) United States Patent
Hara et al.

(10) Patent No.: US 9,988,233 B2
(45) Date of Patent: Jun. 5, 2018

(54) SHEET STACKING DEVICE

(71) Applicants: Yoshiyuki Hara, Tokyo (JP); Hideki Aoyagi, Yamanashi-ken (JP)

(72) Inventors: Yoshiyuki Hara, Tokyo (JP); Hideki Aoyagi, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days. days.

(21) Appl. No.: 15/392,157

(22) Filed: Dec. 28, 2016

(65) Prior Publication Data

US 2017/0183186 A1 Jun. 29, 2017

(30) Foreign Application Priority Data

Dec. 28, 2015 (JP) ..... 2015-256973

(51) Int. Cl.

| | |
|---|---|
| ***B65H 31/04*** | (2006.01) |
| ***B65H 31/18*** | (2006.01) |
| ***B65H 7/02*** | (2006.01) |
| ***B65H 7/20*** | (2006.01) |
| ***B65H 31/08*** | (2006.01) |
| ***B65H 43/02*** | (2006.01) |
| ***B65H 31/02*** | (2006.01) |
| ***B65H 31/10*** | (2006.01) |

(Continued)

(52) U.S. Cl.

CPC ..... *B65H 31/18* (2013.01); *B65H 7/02* (2013.01); *B65H 7/20* (2013.01); *B65H 31/02* (2013.01); *B65H 31/08* (2013.01); *B65H 31/10* (2013.01); *B65H 31/3027* (2013.01); *B65H 33/08* (2013.01); *B65H 43/02* (2013.01); *B65H 2301/4212* (2013.01); *B65H 2301/4213* (2013.01); *B65H 2404/1321* (2013.01); *B65H 2404/1441* (2013.01); *B65H 2404/1521* (2013.01); *B65H 2404/693* (2013.01); *B65H 2405/11151* (2013.01); *B65H 2511/11* (2013.01); *B65H 2511/152* (2013.01); *B65H 2511/20* (2013.01); *B65H 2515/112* (2013.01); *B65H 2553/00* (2013.01); *B65H 2553/612* (2013.01); *B65H 2801/06* (2013.01); *B65H 2801/27* (2013.01)

(58) Field of Classification Search

CPC ..... B65H 31/02; B65H 31/04; B65H 31/08; B65H 31/12; B65H 31/18; B65H 43/02

See application file for complete search history.

(56) References Cited

U.S. PATENT DOCUMENTS 4,938,467 A * 7/1990 Honjo ..... B65H 31/08 271/202
5,192,261 A * 3/1993 Honjo ..... B65H 31/08 209/942

(Continued)

FOREIGN PATENT DOCUMENTS

JP 2009-035371 A 2/2009
JP 2014-047028 A 3/2014

*Primary Examiner* — Prasad V Gokhale
(74) *Attorney, Agent, or Firm* — Manabu Kanesaka

(57) ABSTRACT

The present invention is to provide a sheet stacking device for stacking sheets on which an image is formed, in which an initial operation time at the time the device is turned on is shortened, and, at the same time, the initial operation is simplified. This configuration enables reduction in operation noise and a prompt start at the time when the device is started.

7 Claims, 26 Drawing Sheets

(51) Int. Cl.
*B65H 31/30* (2006.01)
*B65H 33/08* (2006.01)

(56) References Cited

U.S. PATENT DOCUMENTS

| | | | | |
|---|---|---|---|---|
| 7,267,337 | B2 * | 9/2007 | Moore | B65H 1/18 271/148 |
| 2011/0031678 | A1 * | 2/2011 | Iizuka | B65H 31/10 271/3.16 |
| 2014/0061993 | A1 * | 3/2014 | Shimura | B65H 39/00 270/58.09 |
| 2014/0197594 | A1 * | 7/2014 | Suzuki | B65H 43/06 271/213 |

* cited by examiner

| | Sensor 1 | Sensor 2 | Sensor 3 |
|---|---|---|---|
| (Ⅰ) Straight sheet discharge appropriate height | ON | ON | |
| (Ⅱ) Straight, tray at high position | OFF | ON | |
| (Ⅲ) Straight, tray at low position | ON | OFF | |
| (Ⅳ) Sheet bundle discharge appropriate height | ON | | ON |
| (Ⅴ) Sheet bundle, tray at high position | ON | | OFF |
| (Ⅵ) Sheet bundle, tray at low position | OFF | | ON |

Standby state

Low pressure state

High pressure state

SHEET STACKING DEVICE

RELATED APPLICATIONS

The present application is based on, and claims priority from, Japanese Application No. JP2015-256973 filed Dec. 28, 2015, the disclosure of which is hereby incorporated by reference herein in its entirety.

BACKGROUND OF THE INVENTION

Field of the Invention

The present invention relates to a sheet stacking device that stores sheets with an image formed by an image forming device such as a copier directly on a stacking tray without performing post-processing, or stacks and stores, on the stacking tray, such sheets that have been formed into sheet bundles through post-processing such as binding processing.

Description of the Related Art

A sheet stacking device of the above type receives sheets discharged from an image forming device, guides them to a sheet discharge path in the device, and stores them in a state where they are stacked on a stacking tray disposed on a downstream side of the sheet discharge path. Alternatively, the sheets are subject to post-processing such as binding processing, and then stacked on the stacking tray.

The stacking tray that stores sheets in a stacked state is moved up and down in accordance with an amount of stacked sheets. Therefore, the sheet stacking device includes a sheet surface detection sensor for detecting a height of a top sheet of the sheets stacked on the stacking tray and an elevation means for raising and lowering the stacking tray based on a detection result of the sheet surface detection sensor.

The above sheet stacking device needs to detect a position of a top surface of the sheets stacked on the sheet stacking tray by using a sensor lever not only during sheet stacking operation but also when the sheet stacking device is turned on, in order to stack and store the sheets or bundles of sheets on the stacking tray in an accurately aligned state (for example, see Patent Document 1).

As an example of detecting a position of a top surface of sheets stacked on the sheet stacking tray, there has been known a technique of providing an optical level sensor and adjusting a height of the sheet stacking tray to be within an appropriate range based on detection results of the level sensor and a sensor flag (for example, see Patent Document 2).

The level sensor in Patent Document 2 detects a height of a surface of sheets stacked on a stacking tray by swinging and emerging above the sheet stacking surface.

PRIOR ART DOCUMENT

Patent Document

[Patent Document 1] JP2009-035371A

[Patent Document 2] JP2014-047028A

The above sheet stacking device requires appropriate initial operation of the stacking tray, since the device needs to detect a height level of a stacked sheet surface on the stacking tray and appropriately receive a sheet discharged from a discharge port of the sheet stacking device by positioning the stacking tray at an appropriate height based on a detection result not only during operation of the device for continuously discharging the sheets onto the stacking tray but also when the device is turned on or operation is resumed as described above.

In the initial operation of the stacking tray in the conventional sheet stacking device, the stacking tray is lowered to a predetermined position first and then raised to a predetermined appropriate position in a fixed routine, so that the stacking tray is positioned at a secure height.

However, in the initial operation of the conventional sheet stacking tray that is performed when power is turned on, the same initial operation, in which the stacking tray is lowered to a predetermined position first and then raised to a predetermined appropriate position, is performed every time regardless of a height of a stacked sheet surface. Accordingly, a comparatively long period of time is required from when a power-on signal or an operation start signal is received until when the sheet stacking device enters a standby state in which the device is ready for use.

SUMMARY OF THE INVENTION

An object of the present invention is to shorten a time period required for the initial operation of the sheet stacking device in accordance with a situation of a sheet surface on the stacking tray to allow the device to be ready for use promptly, and to secure detection of a sheet surface even when a sheet surface detection mechanism has difficulty in tracking a motion of the stacking tray due to restriction on devices, including a sheet surface detection mechanism.

In view of the above, the inventor of the present invention has arrived at the idea of allowing the sheet stacking device to perform a plurality of different initial operations for the stacking tray of the sheet stacking device in accordance with states of a surface of stacked sheets on the stacking tray instead of the operation control in a fixed routine described above.

To achieve the above object, the sheet stacking device according to the present invention includes a stacking tray on which discharged sheets are stacked, an elevation unit that raises and lowers the stacking tray, a sheet surface detection unit that detects a sheet surface height of a top sheet stacked on the stacking tray, and a control unit that controls the elevation unit based on a detection result of the sheet surface detection unit. The control unit executes initial operation, in which the stacking tray is moved within a predetermined range set in advance before a sheet is discharged on the stacking tray.

(a) When the sheet surface height is within the predetermined range, the initial operation is ended without further operation. (b) When the sheet surface height is below the predetermined range, the elevation unit is raised, and the initial operation is ended at a time point at which the sheet surface height enters the predetermined range. (c) When the sheet surface height is above the predetermined range, the elevation unit is temporarily lowered to shift the sheet surface height to be below the predetermined range, and then the elevation unit is raised to shift the sheet surface height to be within the predetermined range.

The present sheet stacking device further includes a sheet presence/absence detection unit that detects presence or absence of a sheet on the stacking tray. In the initial operation, when a detection result of the sheet presence/absence detection unit shows that there is no sheet, the control unit causes the elevation unit to temporarily lower to shift the sheet surface height to be below the predetermined range regardless of a detection result of the sheet surface detection unit, and then causes the elevation unit to rise to shift the sheet surface height to be within the predetermined range.

The sheet surface detection unit is also configured to be able to emerge on the stacking tray. In the initial operation, when the sheet surface height is determined, by the sheet surface detection unit, to be higher than the predetermined range, the control unit, after retracting the sheet surface detection means from the stacking tray, temporarily lowers the elevation unit to move the stacking tray below the predetermined range, and then performs sheet surface detection again.

The stacking tray may include an inclined surface on which an end section of a discharged sheet abuts for alignment of the sheet.

The sheet surface detection mechanism includes a rotating mechanism to emerge on the stacking tray, and a pressing mechanism that presses a sheet on the stacking tray.

When a length in a transfer direction of discharged sheets is larger than a predetermined length and a grammage of the sheets is larger than a predetermined value, or when a length in a transfer direction of discharged sheets is smaller than a predetermined length and a grammage of the sheets is smaller than a predetermined value, the control unit causes the elevation unit to temporarily lower to shift the sheet surface height to be below the predetermined range and then causes the elevation unit to rise to shift the sheet surface height to be within the predetermined range, regardless of a detection result of the sheet surface detection unit.

The present invention detects a top surface of sheets stacked on the stacking tray and performs a plurality of different initial operations in accordance with a detection result of the top surface in the initial operation of the stacking tray performed when the sheet stacking device is activated. In this manner, the present invention can provide functions and advantages to be described below.

First, as described above, according to the invention of the first aspect, when a height of a surface of sheets stacked on the stacking tray at the time of the initial operation is within a predetermined range, the initial operation is ended without further operation unlike the conventional technique. When a height of the stacked sheet surface is below the predetermined range, the stacking tray is raised to shift the height of the stacked sheet surface to be within the predetermined range. When a height of the stacked sheet surface is above the predetermined range, the stacking tray is temporarily lowered and then raised again to shift the height of the stacked sheet surface to be within the predetermined range. Accordingly, the stacking tray can be moved to an accurate position while a time period required for the initial operation of the stacking tray is curtailed.

According to the invention of the second aspect, when there is no sheet on the stacking tray, the tray is moved up from a lower position for positioning. Accordingly, accurate positioning can be performed, and alignment of a sheet discharged first is improved.

According to the invention of the third aspect, the sheet surface detection unit is retracted once to create a space in which the sheet surface detection unit can be moved above the stacking tray, and then sheet surface detection is performed. Accordingly, sheet surface detection is ensured without erroneous detection caused by drive resistance and the like.

According to the invention of the fourth aspect, an inclined surface is provided on the stacking tray to increase alignment speed for a dropped sheet, so that sheets can be stacked at a higher speed.

According to the invention of the fifth aspect, a mechanism for pressing sheets is provided in the sheet surface detection mechanism. In this manner, erroneous detection caused by swelling of sheets and the like can be prevented.

According to the invention of the sixth aspect, when sheets that satisfy a predetermined condition are discharged, the initial operation is varied in accordance with the property of the discharged sheets. Accordingly, there is no adverse influence on sheet stacking performance, such as that sheets on the sheet stacking tray are misaligned, folded, or the like.

According to the invention of the seventh aspect, a post-processing device providing the above advantages can be provided.

According to the invention of the eighth aspect, an image formation system providing the above advantages can be provided.

According to the invention of the ninth aspect, the initial operation is varied in accordance with a height of a sheet surface on the stacking tray at the time of the initial operation so as to shorten the length of an initial time.

Omission of operation and reduction in operation noise generated in the initial operation of the stacking tray can be achieved.

BRIEF DESCRIPTION OF THE DRAWINGS

FIGS. 4A and 4B are explanatory views of an inversion roller mechanism in the post-processing device of FIG. 2, in which FIG. 4A is an explanatory view of an entire configuration of the inversion roller mechanism, and FIG. 4B is an explanatory view showing a shape of an inversion roller;

FIGS. 5A to 5C are explanatory views showing operation states of the inversion roller mechanism, in which FIG. 5A shows a standby state in which an upper roller is separated from a lower roller, FIG. 5B shows a state in which the upper roller is in engagement with the lower roller with a low pressing force, and FIG. 5C shows a state in which the upper roller is in engagement with the lower roller with a high pressing force;

FIGS. 6A and 6B are explanatory views showing engagement states of the upper roller and the lower roller in FIGS. 5A to 5C, in which FIG. 6A shows pressed surfaces of the upper roller and the lower roller which are in engagement with a low pressing force, and FIG. 6B shows pressed surfaces of the upper roller and the lower roller which are in engagement with a high pressing force;

FIGS. 12A and 12B are views that explain the sheet pressing unit that detects a height of sheets stacked on the stacking tray, in which FIG. 12A shows a shape of a sensor flag of the sheet pressing unit, and FIG. 12B shows a relationship between a sensor and a tray position;

FIGS. 13A to 13C are explanatory views showing operation states of the sheet pressing unit, in which FIG. 13A shows a standby state of the sheet pressing unit, FIG. 13B shows a state in which the sheet pressing unit punches a rear end of a sheet bundle stacked on the tray (low pressure state), and FIG. 13C shows a state in which the sheet pressing unit presses a top sheet on the tray (high pressure state);

FIGS. 16A and 16B show operation states of the rear end support member, in which FIG. 16A shows a state in which the support member enters the stacking tray and FIG. 16B shows a state in which the support member that enters the tray supports a sheet bundle;

FIGS. 18A to 18D are state explanatory views showing relationships between a sheet bundle stored on the tray and the rear end support member, in which FIG. 18A shows a state in which the support member enters the tray, FIG. 18B shows a state in which the support member supports a rear end of a dropping sheet bundle, FIG. 18C shows an initial state of the rear end support member to be retracted from the tray, and FIG. 18D shows a state in which the rear end support member is retracted from the tray;

FIGS. 20A and 20B are explanatory views of a sheet discharge mode in which sheets sent to a sheet discharge path are stored on the stacking tray one sheet at a time, in which FIG. 20A is an explanatory view of an operation flow of jog sheet discharge in which sheets are aligned and sorted into sets on the stacking tray, and FIG. 20B is an explanatory view of an operation flow in which a sheet bundle is removed from the tray while a jog sheet discharge mode is executed;

DESCRIPTION OF THE EMBODIMENTS

Hereinafter, description will be given of details of the present sheet stacking device in accordance with preferred embodiments.

Figure 1:
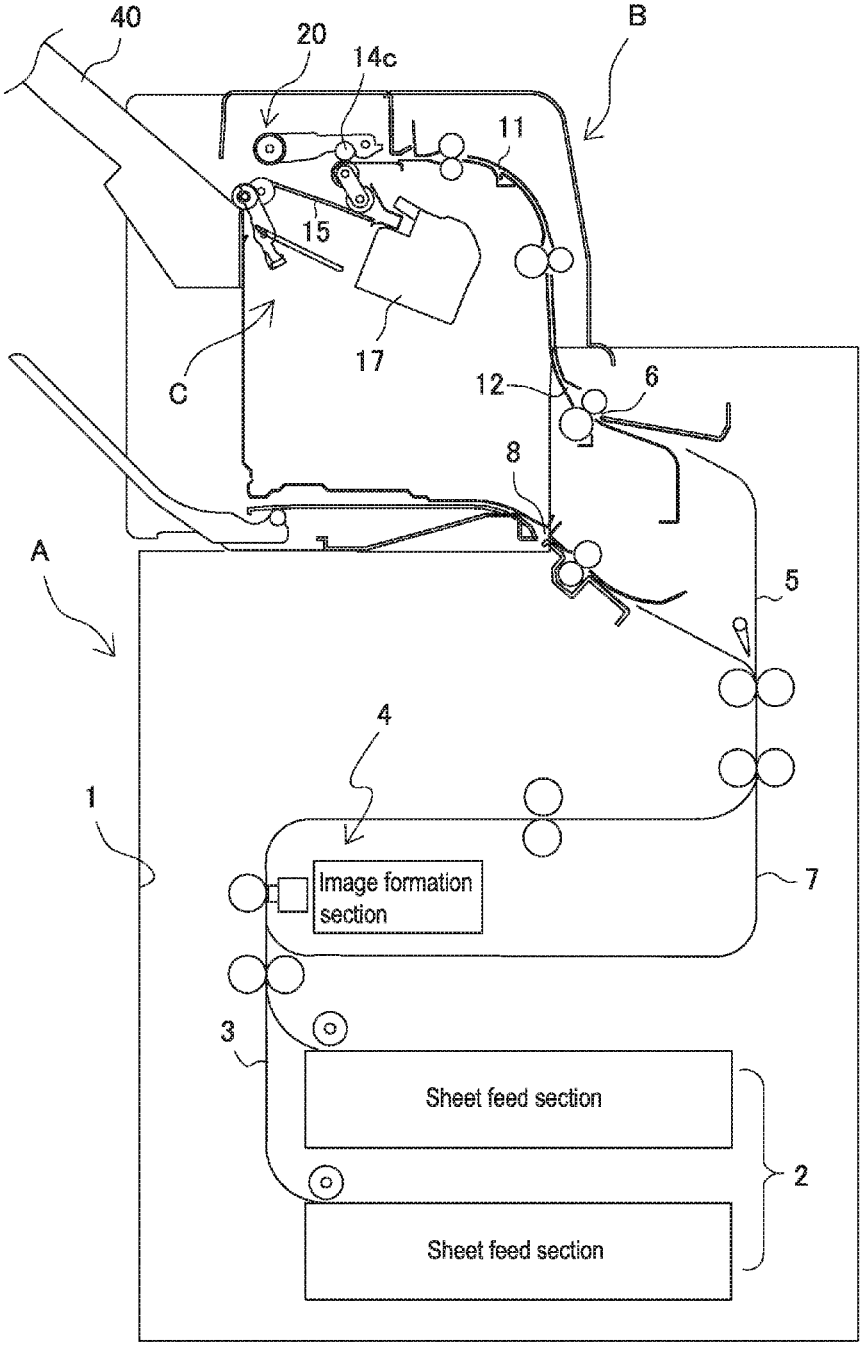
FIG. 1 is an explanatory view of an entire configuration of an image formation system according to the present invention.

FIG. 1 shows an image formation system, which is comprised of an image formation device (unit) A that forms an image on a sheet and a post-processing device (unit) B that stacks sheets on which an image is formed by aligning them for each set and applies post-processing, including binding processing. A sheet stacking device (unit) C according to the present invention is incorporated in the post-processing device B. Hereinafter, description will be given of the image formation device and the post-processing device in this order.

(Image Formation Device)

The image formation device A shown in FIG. 1 is connected to image handling devices (not shown), such as a computer and a network scanner, forms an image on a designated sheet based on image data transferred from the devices, and discharges the sheet to a predetermined discharge port (a sheet discharge port to be described later). Apart from the above network configuration, the image formation device A is configured as a copier and a facsimile, and copies an image on a sheet based on data which is obtained by a document scanning unit that reads image.

Therefore, in the image formation device A, a plurality of sheet feed cassettes 2 are provided in a housing 1, and a sheet of a selected size is fed from the cassette to a sheet feed path 3 on a downstream side. An image formation mechanism (image formation section) 4 is provided in the sheet feed path 3. A variety of mechanisms are known as the image formation mechanism. For example, there are known an inkjet printing mechanism, an electrostatic printing mechanism, an offset printing mechanism, a silkscreen printing mechanism, a ribbon transfer printing mechanism, and the like. The present invention can employ any of the printing mechanisms.

A sheet discharge path 5 is provided on a downstream side of the image formation mechanism 4, and sheets are discharged from a sheet discharge port 6 (hereinafter referred to as the main body sheet discharge port) disposed in the housing 1. A fixing unit (not shown) is incorporated in the sheet discharge path 5 depending on printing mechanisms. In the above manner, a sheet of a selected size is sent from the sheet feed cassette 2 to the image formation section 4, and, after an image is formed, the sheet is discharged from the sheet discharge path 5 to the main body sheet discharge port 6. In addition to the above, a duplex path 7 is disposed in the housing 1. The duplex path 7 is used for a sheet having an image on its front surface that has been formed in the image formation section 4, allowing the image-formed sheet to return therethrough to the image formation section 4 again after the front and back surfaces of the sheet are inverted in the device. After an image is formed on the back surface of the sheet, the sheet is discharged from the main body sheet discharge port 6. In the illustrated device, a sheet is temporarily discharged outside the housing from a discharge port 8 (see FIG. 1) which is distinct from the main body sheet discharge port 6, and then is carried into the device in a switchback manner. The sheet then has the front and back surfaces inverted, and is resent to the image formation section 4.

The post-processing device B to be to be described later is connected to the main body sheet discharge port 6. There is also known a device configuration assembling a scanner unit and a document feeding unit that feeds a document sheet to the scanner unit in an integrated manner in the housing 1. The scanner unit in this case scans a document sheet which is placed on a platen or fed from a feeder mechanism to read an image, and transfers the read data to an image formation unit. The document feeding unit includes a feeder mechanism that feeds a document sheet to a platen of the scanner unit. The present invention can employ a device configuration that includes the above units in an integrated manner.

(Post-Processing Device)

Figure 2:
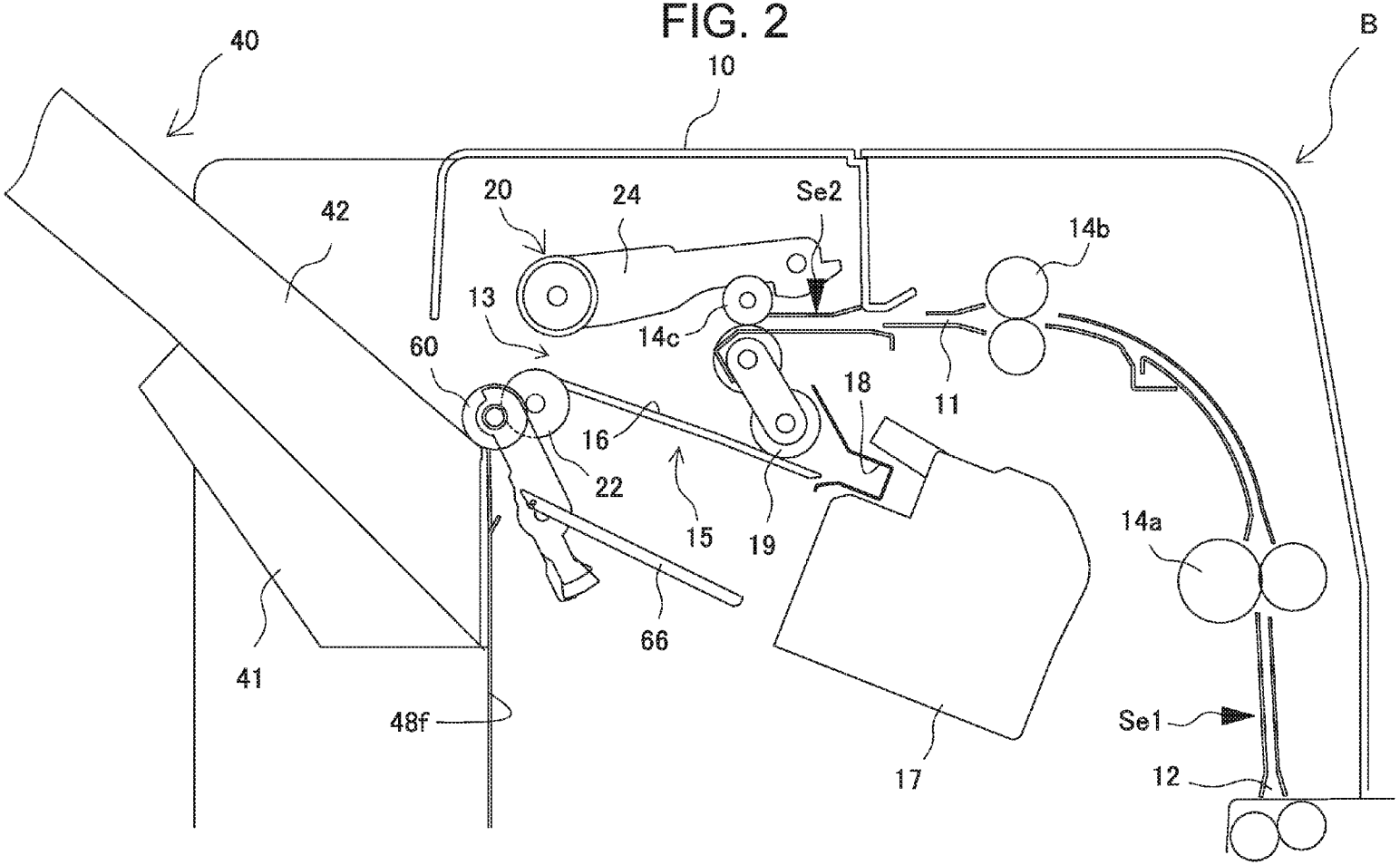
FIG. 2 is a configuration explanatory view of a post-processing device in the image formation system of FIG. 1.

The post-processing device B shown in FIG. 2 is comprised of a housing 10, a sheet carrying path (sheet discharge path; the same applies hereinafter) 11 incorporated in the housing, a processing tray 15, and a stacking tray 40. Hereinafter, description will be given of the configurations of the foregoing elements of the post-processing device.

(Sheet Carrying Path)

The sheet carrying path 11 includes a carry-in port 12 provided next to the main body sheet discharge port 6 of the image formation device A described above, and a sheet discharge port 13. A sheet on which an image is formed is carried from the carry-in port 12 into the post-processing device, and discharged to the sheet discharge port 13. The sheet carrying path 11 is configured as a sheet discharge path for transferring a sheet sent from the main body sheet discharge port 6 to the stacking tray 40 to be described later. A receiving sensor Se1 that detects a front end of a sheet is arranged in the carry-in port 12. A sheet discharge sensor Se2 that detects a rear end of a sheet is arranged in the sheet discharge port 13. Carrying rollers 14*a* and 14*b* for carrying a sheet are arranged in the path at an appropriate interval. A roller drive motor (not shown) is connected to the carrying rollers 14*a* and 14*b*. The illustrated sheet carrying path 11 is configured as a substantially straight path in a substantially horizontal direction that traverses the housing 10. The processing tray 15 and the stacking tray 40 are disposed on a downstream side of the sheet discharge port 13 of the sheet carrying path 11 in a configuration to be to be described below.

(Processing Tray)

As shown in FIG. 2, the processing tray 15 forms a height difference with respect to the sheet discharge port 13, and a downstream side of the processing tray 15 is comprised of a sheet placing table 16 on which a sheet is stacked and supported, a sheet aligning unit (not shown) disposed on the sheet placing table, and a post-processing unit 17. The illustrated sheet placing table 16 is formed in a profile to support a rear end section of a sheet which is back-transferred (fed in a direction opposite the sheet discharge direction) from the sheet discharge port 13. In the configuration, a front end section of a sheet is supported on the stacking tray 40, while a rear end section of the sheet is supported on the sheet placing table 16 (bridge support). As described above, the stacking tray 40 and the processing tray 15 are disposed on a substantially same plane, and a first half of a sheet is supported by one of the trays and a second half is supported by the other tray. In this manner, the device can be downsized as compared to a case where a plurality of trays are disposed on front and rear sides to support an entire sheet.

On the sheet placing table 16, there are provided a rear-end regulation stopper 18 on which a rear end of a sheet is abut and regulated, and an alignment mechanism (not shown) that aligns the width of sheets in a direction orthogonal to the sheet discharge direction. Description is omitted for the alignment mechanism, for which a variety of systems have already been known. A sheet which is carried onto the processing tray is positioned in accordance with a standard (center reference, side reference) set in advance. The illustrated device shows a center standard.

A staple unit that performs binding processing for sheet bundles which are aligned for each set and stacked on the sheet placing table 16 is arranged as the post-processing unit 17. The staple unit is known as a device that folds a staple having a linear shape into a U-shape, and inserts the staple in a sheet bundle from an upper surface to a lower surface, and then folds front ends of the staple. A staple unit, a punch unit, a stamp unit, a trimmer unit, or the like is employed as the post-processing unit 17 in accordance with the specifications of the device.

An inversion roller mechanism 20 is disposed in the sheet discharge port 13 of the sheet carrying path 11. The inversion roller mechanism 20 carries a sheet sent to the sheet discharge port 13 to a downstream side in the sheet discharge direction, and inverts the transfer direction when a rear end of the sheet passes through the sheet discharge port 13. In this manner, the sheet is guided from the rear end side in the sheet discharge direction to the rear-end regulation stopper 18 along the sheet placing table 16 of the processing tray 15.

On the processing tray 15, there is disposed a frictional rotator 19 that guides a sheet to the rear-end regulation stopper 18 in cooperation with the inversion roller mechanism 20 to be described more specifically later which is disposed in the sheet discharge port 13. The illustrated frictional rotator 19 is disposed at a position at which the frictional rotator 19 is in engagement with a sheet stacked on the sheet placing table 16. The frictional rotator 19 is configured by a raking roller (or belt), and is driven by a drive belt so as to rotate in a manner integral with a sheet discharge roller 14*c*. The frictional rotator 19 is in engagement with a stacked sheet by its own weight. A sheet that is carried back from the inversion roller 20 by rotation of the frictional rotator 19 which functions as a raking roller is carried to the rear-end regulation stopper 18 and stops by abutting on the rear-end regulation stopper 18.

(Inversion Roller Mechanism)

Figure 3:
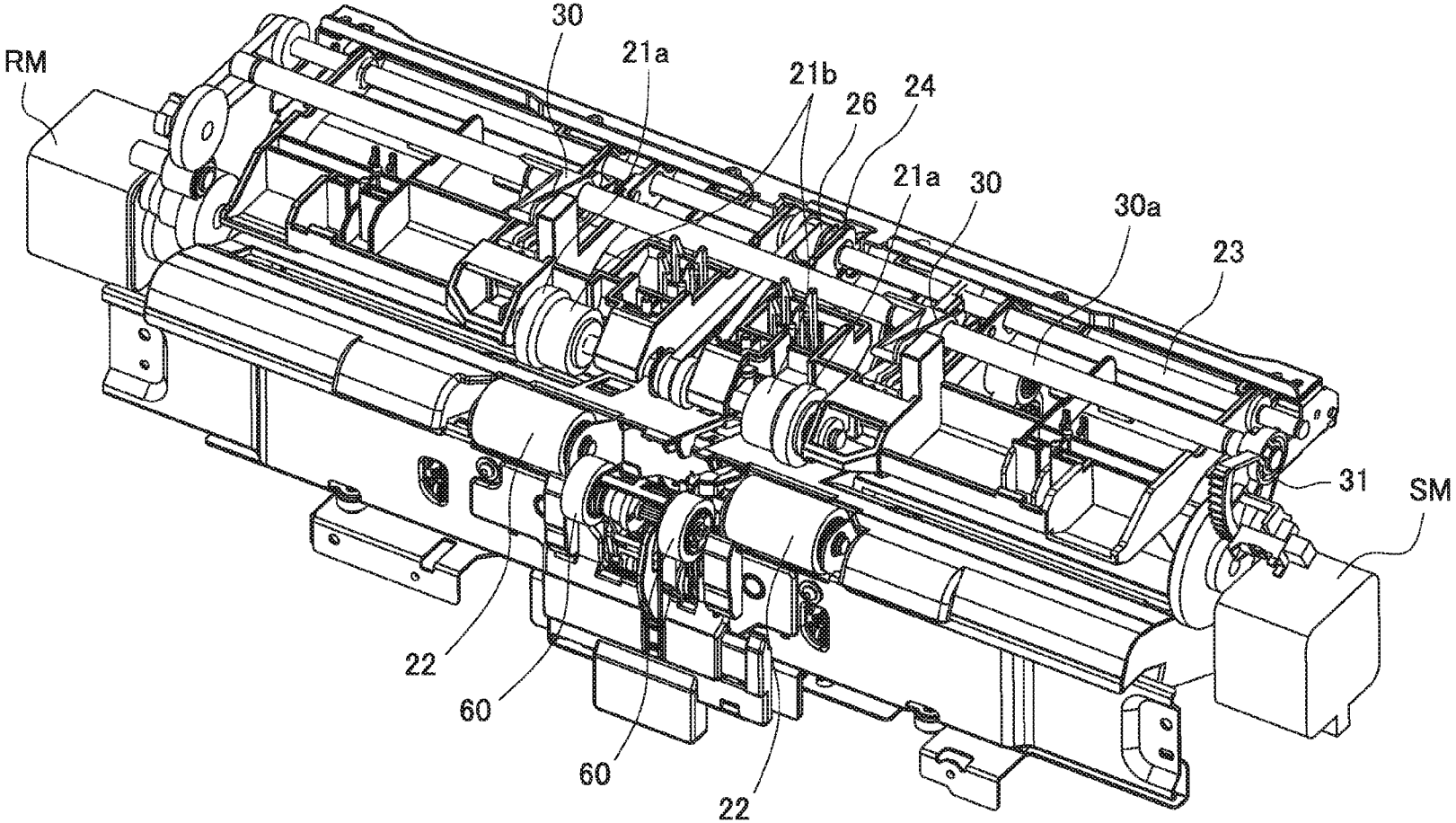
FIG. 3 is a perspective configuration explanatory view of a sheet discharge section mechanism in the post-processing device of FIG. 2.
Figure 4A:
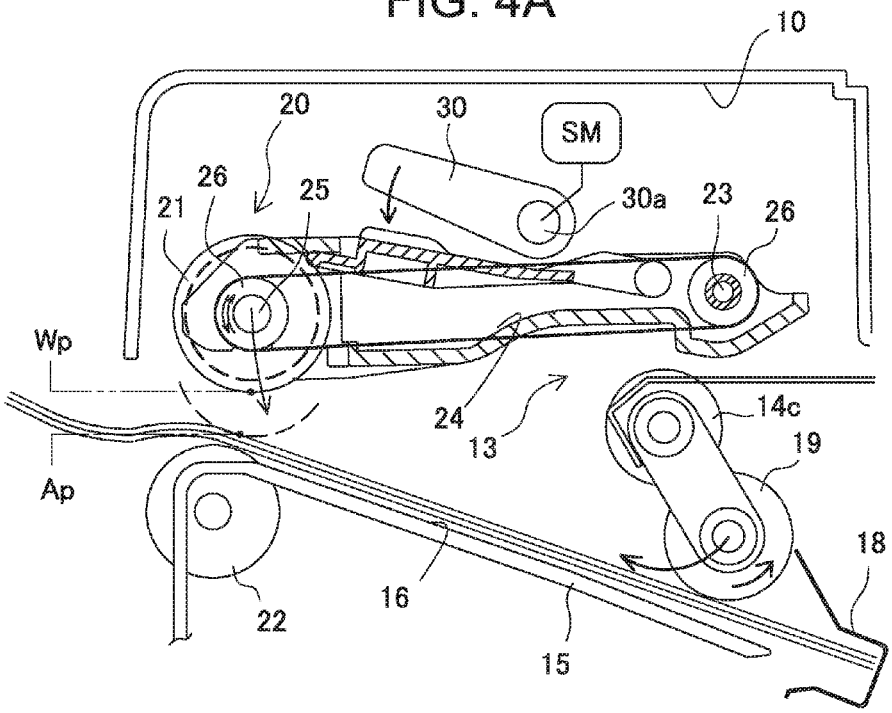
Figure 4B:
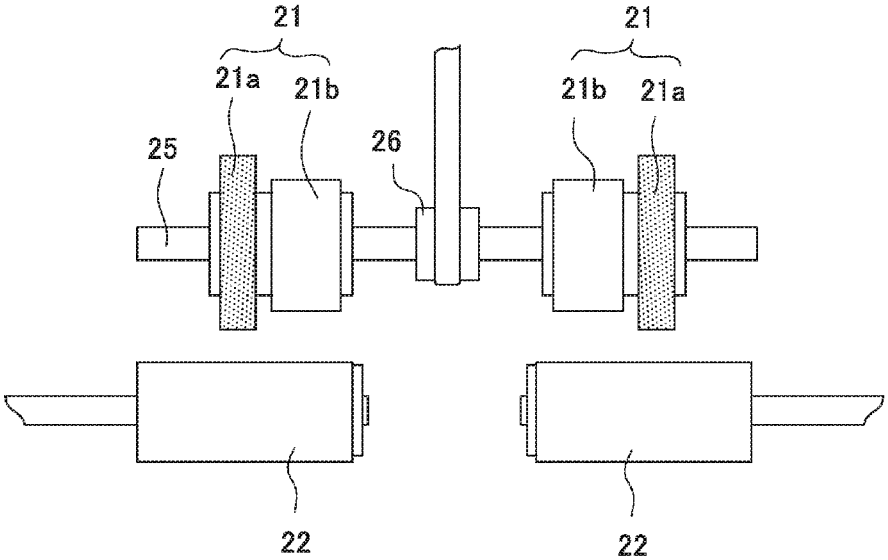

FIG. 3 is a perspective explanatory view showing a sheet discharge section mechanism of the post-processing device B. A pair of the inversion rollers 20 are disposed in the center in a width direction of a sheet carried from the sheet discharge port 13. The inversion roller 20 transfers a sheet delivered from the sheet discharge port 13 in the sheet discharge direction, and then inverts the transfer direction and carries the sheet onto the processing tray 15. FIGS. 4A and 4B show the inversion roller mechanism 20 in detail. FIG. 4A shows a roller up/down mechanism of the inversion roller 20, and FIG. 4B shows a roller structure of an upper roller 21 and a lower roller 22. The inversion roller mechanism 20 consists of the upper roller 21 that is in engagement with a top surface of a sheet delivered from the sheet discharge port and the lower roller 22 that is in engagement with a bottom surface of the sheet. The upper roller 21 is supported in a swingable manner by a device frame F, and can be moved up and down between an actuation position Ap at which the upper roller 21 is pressed against the lower roller 22 and a standby position Wp at which the upper roller 21 is separated from the lower roller 22. At the same time, rotation of a roller drive motor (forward-reverse motor) RM is transmitted to the upper roller 21, which allows the upper roller 21 to rotate in the sheet discharge direction (clockwise direction in the diagram) and a direction opposite the sheet discharge direction (counterclockwise direction in the diagram).

In the device frame F, a pair of left and right roller brackets (swinging arms) 24 are supported in a manner swingable about a swing fulcrum 23. A roller rotation shaft 25 is bearing supported in a rotatable manner by the pair of roller brackets 24, and the upper roller 21 is fitted to the rotation shaft. The swing fulcrum 23 is supported by the device frame in a rotatable manner or by a fixing unit. The roller bracket 24 is fitted to the swing fulcrum 23 directly or with a collar member provided between them. In this manner, a bracket base end section is supported in a swingable manner in a certain angular direction about the swing fulcrum 23. A collar member (rotating collar) is loosely fitted to the rotation fulcrum 23 and a drive pulley 26 that transmits rotation to the rotation shaft 25 of the upper roller 21 is connected to the collar member. The roller drive motor RM is connected to the drive pulley 26.

The roller bracket 24 is provided with the roller up/down mechanism that moves up and down between the standby position Wp at which the upper roller 21 is separated from the lower roller 22 and the actuation position Ap at which the upper roller 21 is pressed against the lower roller 22.

Figure 5A:
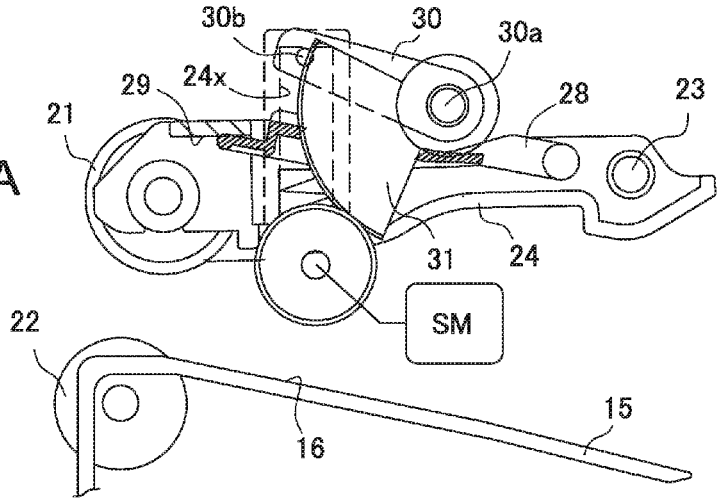
Figure 5B:
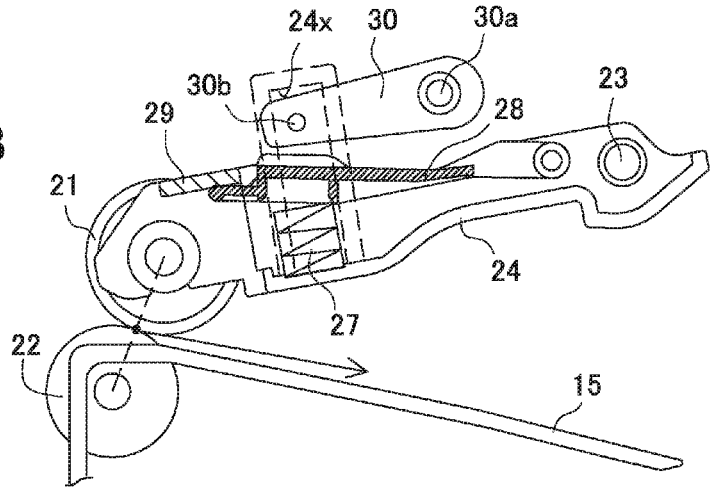
Figure 5C:
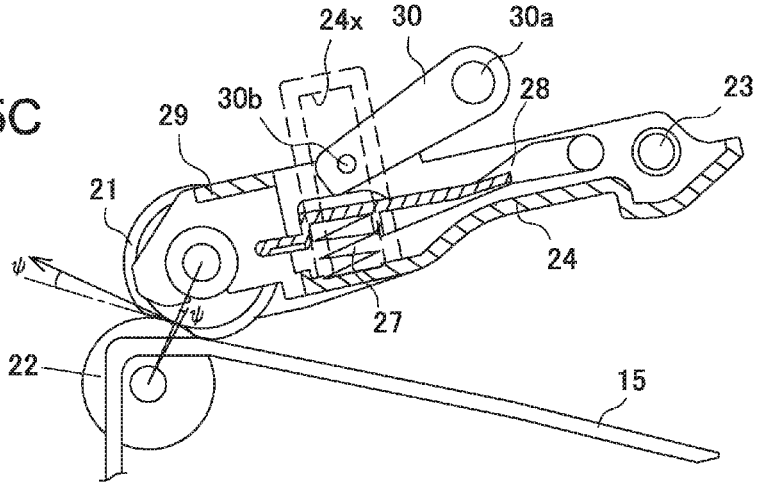

FIGS. 5A to 5C are mechanism diagrams for explaining the roller up/down mechanism. As shown in FIG. 5A, an up/down motion lever 30 is disposed in a motion trajectory of the roller bracket 24 that swings at the swing fulcrum 23. The up/down motion lever 30 has a base end section supported by a rotation shaft 30*a* in a swingable manner. The rotation shaft 30*a* is connected to an up/down drive motor SM with a fan-shaped gear 31 provided between them. The up/down motion lever 30 is configured to rotate (swing) within a predetermined angular range by rotation of the up/down drive motor SM.

An actuation pin 30*b* is integrally formed in a front end section of the rotation shaft 30, and an engagement section (long groove) 24*x* that is in engagement with the actuation pin 30*b* is formed on the roller bracket 24. When the actuation pin 30*b* is in engagement with the engaged section 24*x* as shown in FIG. 5A, the roller brackets 24 is positioned at a standby position. When the actuation pin 30*b* is in a state of being separated from the engagement section 24*x*, the roller bracket 24 is positioned at an actuation position at which the upper roller 21 is pressed against the lower roller 22 by the own weight of the roller bracket 24.

When the actuation pin 30*b* presses down a movable bar 28, a pressurizing spring 27 contracts, and a spring force of the pressurizing spring 27 is applied to the roller bracket 24 as a pressing force between the upper roller 21 and the lower roller 22. When the up/down motion lever 30 is changed from the state of FIG. 5A to the states of FIGS. 5B and 5C by angular control of the up/down drive motor SM, a state of the upper roller 21 is changed from the state where the upper roller 21 is separated from the lower roller 22 to the state where the upper roller 21 is pressed with a low pressure force and to the state where the upper roller 21 is pressed with a high pressure force. A stopper piece 29 provided on the roller bracket 24 regulates an upper limit of a swing motion of the movable bar 28.

In the above configuration, when the up/down drive motor SM is rotated in a predetermined direction (clockwise direction in FIG. 5A), the up/down motion lever 30 moves a position of the roller bracket 24 in a direction in which the upper roller 21 is separated from the lower roller 22. In this state, the roller bracket 24 is locked by a stopper (not shown) and moved up to the standby position, and is held at the position by a load of a motor, a transmission mechanism, and the like. When the up/down drive motor SM is rotated in an opposite direction, the up/down motion lever is rotated in a counterclockwise direction in the diagram, the roller bracket 24 is rotated in a direction in which the roller bracket 24 falls (drops) by its own weight about the swing fulcrum 23, and the upper roller 21 is pressed against the lower roller 22.

As the roller moves up and down, the roller drive motor RM transmits rotation to the upper roller 21. The drive motor is configured by a motor which can rotate in forward and reverse directions. In this case, first and second methods to be described below are employed for control of the upper roller 21.

In the first method, a sheet is carried from the sheet discharge port 13 while the upper roller 21 is rotated in the sheet discharge direction in a state where the upper roller 21 is pressed against the lower roller 22. When a front end of a sheet enters in a roller nip, the sheet is sent in the sheet discharge direction by receiving a carrying force from both the sheet discharge roller 14*c* and the inversion roller 20.

Next, in a stage where a rear end of the sheet is separated from the sheet discharge port 13 (immediately after a detection signal of the sheet discharge sensor Se2 is issued), a rotating direction of the upper roller 21 is inverted. At the same time as the rear end of the sheet drops from the sheet discharge port 13 onto the processing tray 15, the front end of the sheet is carried back by the upper roller 21. This sheet discharge method is employed as control which is performed when a first sheet is carried to the processing tray 15 (when sheets do not rub against each other). A pressure force between the upper roller 21 and the lower roller 22 is set to a high pressure force (the state of FIG. 5C).

In the second method, when a preceding sheet has already been stacked on the lower roller 22, a sheet carried out from the sheet discharge port 13 is waited for in a state where the upper roller 21 is held at the standby position. At a timing at which a rear end of the sheet is discharged from the sheet discharge port 13, the upper roller 21 is moved down from the standby position Wp to the actuation position Ap. The roller drive motor RM is rotated in a direction opposite the sheet discharge direction almost simultaneously with the operation of moving down the roller. The sheet delivered from the sheet discharge port then has the rear end thereof dropping onto the processing tray 15, and the sheet is transferred toward the rear-end regulation stopper 18 by a carrying force received from the upper roller 21 with the rear end side at the front. At this time, a pressure force of the upper roller 21 is set to a low pressure force.

In the present invention, description has been made on the configuration in which the upper roller 21 is moved up and down between the standby position, the low pressure position, and the high pressure position by the up/down motion lever 30 different from the roller bracket 24 about the swing fulcrum 23. In addition to the above, a spring clutch is interposed on the swing fulcrum 23 of the roller bracket 24, and a rotation shaft (rotation collar and the like) is driven and rotated in forward and reverse directions through the spring clutch. In this manner, when the rotation shaft is rotated in a direction in which the spring clutch contracts, the roller bracket 24 is moved from a pressing position to a raised position. When the rotation shaft is rotated in a direction of relaxing the spring clutch, the roller bracket 24 is moved down from the raised position to the pressing position. In this case, when a pressurizing force is controlled in two levels, high and low, a pressurizing mechanism (pressing lever and the like) that pressurizes the roller bracket 24 with a spring pressure is added.

Next, description will be given of a configuration of the upper roller 21 and the lower roller 22 in accordance with FIG. 4B. As described above, the upper roller 21 moves between the actuation position Ap at which the upper roller 21 is pressed against the lower roller 22 and the standby position Wp at which the upper roller 21 is separated from the lower roller 22. At the actuation position, a pressure force can be controlled to be in a low pressure state and a high pressure state. The upper roller 21 is configured by a combination of a large-diameter roller body 21*a* and a small-diameter roller body 21*b*. A combination of one, two, or more pairs of the large- and small-diameter roller bodies is arranged in the sheet width direction. In the upper roller 21, the large-diameter roller bodies 21*a* and the small-diameter roller bodies 21*b* are arranged symmetrically at equal distances from the center of a sheet in such a manner that the large-diameter roller bodies 21*a* are located on the outer side of the small-diameter roller bodies 21*b*.

As described above, the upper rollers 21 are comprised of large-diameter and small-diameter roller bodies which are arranged symmetrically with respect to the center of a sheet. The large-diameter roller body 21*a* has an outside diameter larger than that of the small-diameter roller body 21*b* by Δd, and is configured of a soft member, such as soft rubber. On the other hand, the small-diameter roller body 21*b* is smaller than the large-diameter roller body 21*a* by Ad, and is configured of a hard member, such as synthetic resin. In contrast to the upper roller 21 that is comprised of pairs of roller bodies different in outside diameter, the lower roller 22 is comprised of a pair of roller bodies formed of a comparatively hard material and having the same outside diameter.

Figure 6A:
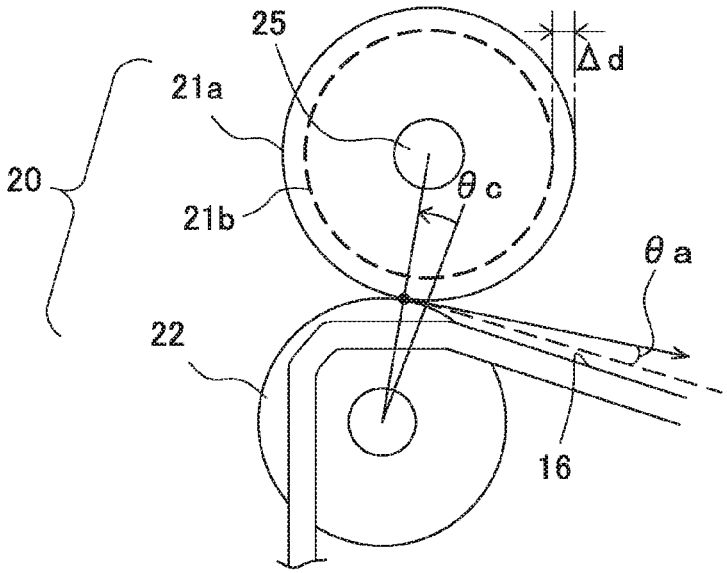
Figure 6B:
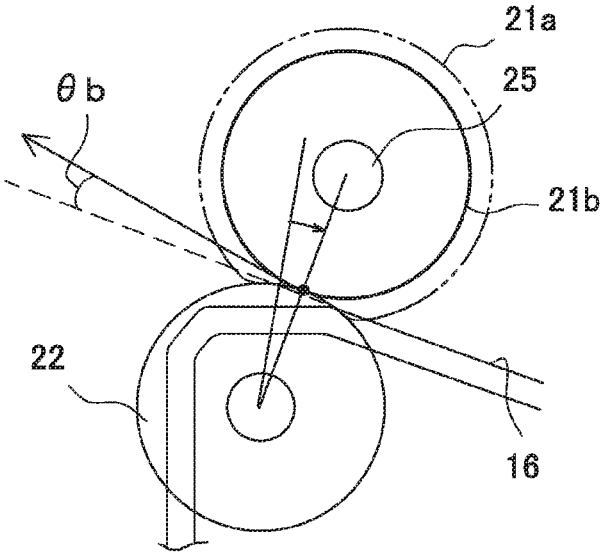

FIG. 6A shows the state where the large-diameter roller body 21*a* of the upper roller is pressed against the lower roller 22. FIG. 6B shows the state where the small-diameter roller body 21*b* of the upper roller is pressed against the lower roller 22. At this time, FIG. 6A is set to be in a low pressure state and FIG. 6B is set to be in a high pressure state.

As shown in FIG. 6A, the large-diameter roller body 21*a* is set to be hard enough to allow a peripheral surface of the large-diameter roller body 21*a* is pressed against a peripheral surface of the lower roller 22 without elastic deformation when a low pressure force is set, in which a pressure force of the up/down motion lever 30 described above does not act. When a high pressure force is applied by the action of the up/down motion lever 30, the large-diameter roller body 21*a* is elastically deformed and the small-diameter roller body 21*b* is pressed against the lower roller 22. As described above, the lower roller 22 is disposed at a position facing the upper roller 21 and is configured of a hard material, such as synthetic resin like Delrin or nylon. The roller bodies of the lower roller 22 have an equal outside diameter. Not that the hard material refers to a material hard enough not to be significantly elastically deformed and that carries a sheet in a state where the outside diameter thereof is maintained almost unchanged even when a high pressure force is applied from the upper roller 21.

A difference (Δd) in outside diameter and a difference in hardness between the large-diameter roller body 21*a* and the small-diameter roller body 21*b* are set in such a manner that, when the large-diameter roller body 21*a* is pressed against the lower roller 22 with a low pressure force, the large-diameter roller body 21*a* is not elastically deformed, and the small-diameter roller body 21*b* is not pressed against the lower roller 22 by forming a gap between them (state of FIG. 6A). When the large-diameter roller body 21*a* is pressed against the lower roller 22 with a high pressure force, the large-diameter roller body 21*a* is elastically deformed and is pressed against the lower roller 22 together with the small-diameter roller body 21*b* (state of FIG. 6B).

When the large-diameter roller body 21*a* is pressed against the lower roller 22 without elastic deformation as shown in FIG. 6A, a contact area is small, and a carrying force applied by rotation of the roller is small. When a sheet is stacked on the lower roller 22, another sheet is delivered and placed on the sheet from the sheet discharge port 13, and the another sheet is carried in an opposite direction of the sheet discharge direction by the upper roller 21, the stacked sheet and the carried-in sheet rub against each other. At this time, if a large pressing force of the rollers is generated, smudging or scuffing in which ink of images is rubbed between the sheets occurs. At the same time, ink and the like attached on a surface of the roller fouls a surface of the sheet facing the roller.

In the illustrated device in a state where the large-diameter roller body 21*a* is in engagement with the lower roller 22 without deformation, a roller pressing angle is set so that a sheet is carried almost in the same direction as a sheet placing surface of the sheet placing table 16 as shown by an arrow in the diagram. That is, an angle θa shown in the diagram is set to zero or close to zero, in order to reduce the degree that a sheet carried to the processing tray 15 rubs against a stacked sheet. Such reduction of a frictional force between sheets is particularly effective when an image is formed by the image formation device A located on an upstream side at high speed, or printing is performed under a condition where smudging or scuffing may occur easily due to a characteristic of an image forming ink.

When the large-diameter roller body 21*a* is pressed against the lower roller 22 with elastic deformation as shown in FIG. 6B, a contact area is large and a carrying force applied to a sheet by rotation of the rollers becomes large. At the same time, in the illustrated device, the sheet is carried in a direction a transfer direction is more upward than a sheet surface on the sheet placing table 16 by an angle θb in the diagram.

By configuring each upper roller 21 with the large-diameter roller body 21*a* and the small-diameter roller body 21*b* and a pressing force applied to each of the roller bodies 21*a* and 21*b* is varied in two levels, high and low, a carrying mechanism of a sheet sent to the sheet discharge port 13 can be changed as shown in FIGS. 6A and 6B in accordance with a carrying mode. That is, when a sheet sent to the sheet discharge port 13 is guided to the processing tray 15 through switchback, smudging or scuffing of ink between sheets is prevented. When a sheet is carried from the sheet discharge port 13 to the stacking tray, a sheet discharge direction is set to an upward direction and the sheet is transferred to the tray in a parabolic direction. In this manner, the sheet can be carried to a comparatively far side on a sheet surface on the tray.

The inversion roller mechanism 20 is configured by a pair of large-diameter and small-diameter rollers as described above for the reasons to be described below. The inversion roller mechanism 20 selectively transfers sheets sent to the sheet discharge port 13 in a "first sheet discharge mode" and a "second sheet discharge mode" to be described later to the stacking tray 40 and the processing tray 15. In the first sheet discharge mode, the sheets sent to the sheet discharge port 13 are nipped between the upper roller 21 and the lower roller 22 one sheet at a time, and fed to the stacking tray 40 on a downstream side. In the first sheet discharge mode, sheet discharge operations are differentiated between jog discharge in which sheets are jog-sorted into sets on the stacking tray and straight discharge in which sheets are carried without being sorted.

Accordingly, in the first sheet discharge mode, since sheets are nipped between the lower roller 22 and the upper roller 21 one sheet at a time, slippage is not generated between the rollers and a sheet and the sheet is ensured to be carried to a downstream side by rotation of the rollers. In the second sheet discharge mode, a sheet delivered from the sheet discharge port 13 is carried onto a top one of the sheets which have already been stacked. The sheet is carried in a sheet discharge direction by sliding on a sheet surface of the top sheet and then carried in a direction opposite to the sheet discharge direction by being pressed by the upper roller 21.

In the carrying modes which are different as described above, sheets (a sheet bundle in a bundle discharge mode to be described later) can be ensured to be discharged and stored on the stacking tray 40 on a downstream side by a strong pressing force in nipping transfer in the first sheet discharge mode. In the second sheet discharge mode, slippage between sheets is unavoidable, and smudging or scuffing of an image formed on a surface of a sheet may be generated in this case. For this reason, sheets should preferably be transferred with a low pressing force.

Surface coating is sometimes applied to a surface of the rollers due to, for example, compatibility (adhesiveness) with image forming ink. In the illustrated rollers, surface hardening processing, such as ceramic coating and fluorine coating, is applied to the surfaces of the small-diameter roller body 21*b* and the lower roller 22 that nip and carry a sheet. In this manner, even if ink is not completely fixed to a sheet, the ink does not adhere to a surface of the rollers, and does not cause smudging or scuffing, or fouling of a subsequent sheet.

In the second sheet discharge mode to be described later, sheets delivered from a sheet discharge port are stacked on the sheet placing table and the lower roller in layers, and a sheet sent onto a top one of the sheets is fed in a sheet discharge direction and then in a direction opposite to the sheet discharge direction by the upper roller to carry the sheet in a switchback manner. The upper roller 21 needs to carry sheets stacked on the sheet placing table 16 and a sheet carried from the sheet discharge port 13 to a predetermined post-processing position in a manner that the sheets do not rub strongly against each other. However, this entails problems that smudging or scuffing of ink of an image formed on the sheet may be generated when sheets rub against each other, and an ink layer attached to a surface of the roller in turn adheres to a surface of the sheet. To solve the problems of an image shift and fouling between the sheets, the upper roller 21 is configured of a large-diameter roller made from a soft material, such as sponge. At the same time, a roller pressing angle is set to θc (see FIG. 6A) so that the roller contact shifts in a direction along a surface of the sheet placing table 16.

At the same time, for a sheet carried onto the processing tray 15, only the large-diameter roller body 21*a* is pressed against a surface of the sheet and the small-diameter roller body 21*b* is not pressed against the surface by forming a gap. For this reason, a contact area between the rollers and the sheet is small. At the same time, a pressing force of the roller is set to a low pressing force. Accordingly, static electricity generated between sheets (a stacked sheet and a carried-in sheet) is weak, and transfer of a subsequent sheet is not interfered with by accumulation of static electricity.

Description has been made on the configuration where binding processing is applied to a sheet bundle stacked on the processing tray 15, and then the sheet bundle is carried to the stacking tray 40 on a downstream side by the inversion roller mechanism 20. In addition to the above, a conveyor unit that is adapted to discharge a sheet bundle from the processing tray 15 may be disposed together with the inversion roller mechanism 20.

The rear-end regulation stopper 18 is configured by a plate member on which a rear end of a sheet abuts to regulate the position of the sheet as shown in FIGS. 4A and 4B. The rear-end regulation stopper 18 is disposed in one location, or a plurality of locations at intervals in the sheet width direction. The stopper is disposed at a rear end edge of a sheet together with post-processing units, such as the staple unit 17. Accordingly, when the staple unit is configured to be movable in the sheet width direction, the rear-end regulation stopper 18 is also configured to move in the sheet width direction in connection with the staple unit 17. When the staple unit 17 is fixed so as not to move in the sheet width direction, the rear-end regulation stopper 18 can also be formed integrally with the staple unit.

(Stacking Tray)

Figure 8:
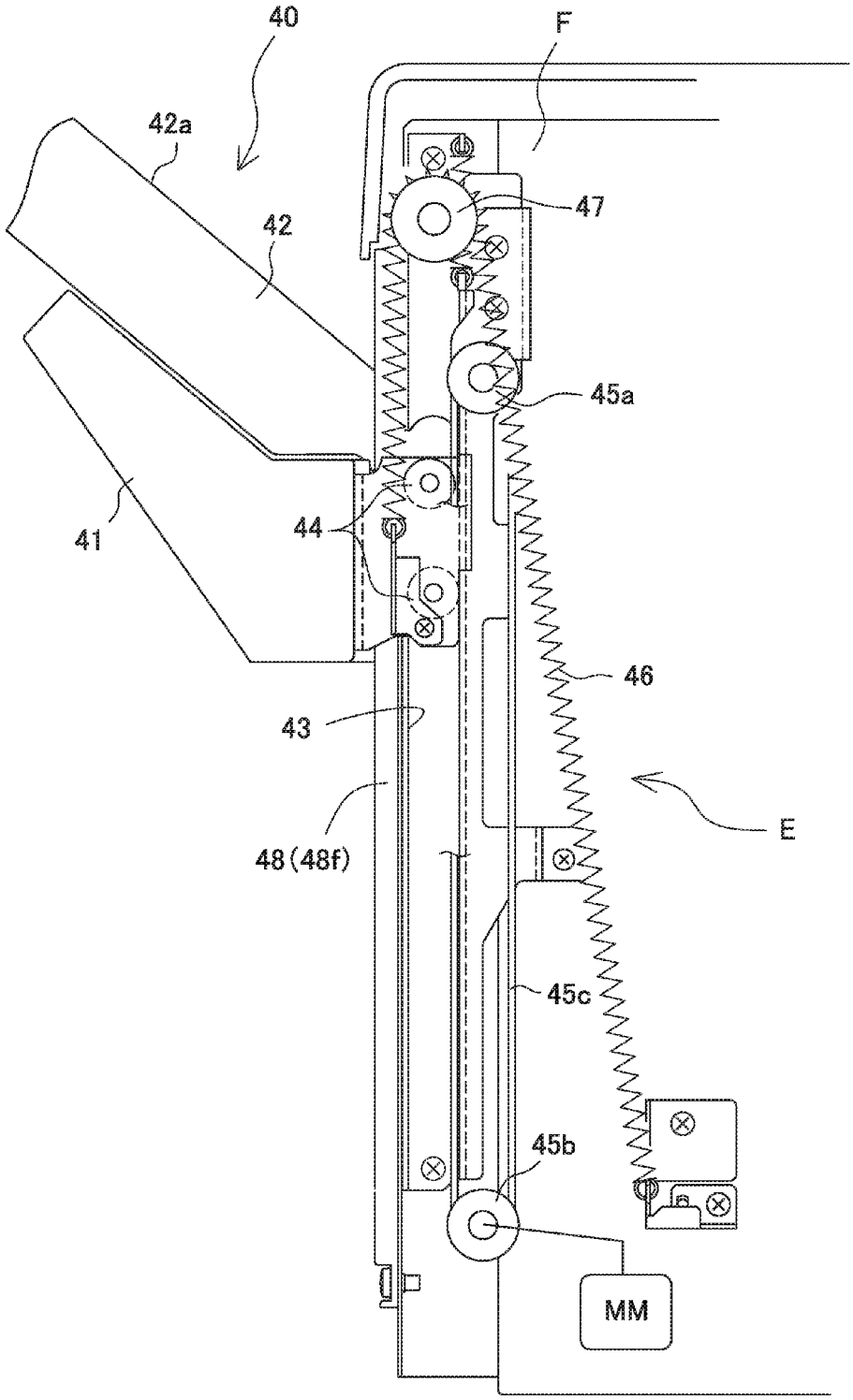
FIG. 8 is an explanatory view of an elevation unit of the stacking tray.

Next, description will be given of the stacking tray. As shown in FIGS. 2 and 8, the stacking tray 40 is disposed on a downstream side of the sheet discharge port 13 of the sheet carrying path 11. The processing tray 15 described above is disposed on a downstream side of the sheet discharge port 13, and the stacking tray 40 is disposed on a downstream side of the sheet discharge port 13 and a discharge port 13 of the processing tray 15. A single sheet is sent out from the sheet discharge port 13, and a sheet bundle is sent out from the discharge port 13. Both the single sheet and the sheet bundle are stored on the stacking tray 40.

In the illustration, the sheet discharge port 13 and the discharge port 13 are provided in substantially the same location. This is because the first sheet discharge mode and the second sheet discharge mode are executed. In the first sheet discharge mode, sheets delivered from the sheet discharge port 13 are directly loaded on the stacking tray 40. In the second sheet discharge mode, sheets sent to the sheet discharge port 13 are carried to the processing tray 15 and subject to post processing, and then carried from the discharge port of the processing tray 15 and loaded on the stacking tray 40. Hereinafter, the sheet discharge port 13 and the discharge port 13 will be described with the same reference number.

The stacking tray 40 is comprised of a tray stand 41 and a sheet placing tray 42. The tray stand 41 is supported by the device frame F in a manner vertically movable in a predetermined stroke. The sheet placing tray 42 is configured to have a tray shape with a tray surface for stacking and storing sheets. The sheet placing tray 42 is supported by the tray stand 41, and the sheet placing tray 42 is provided with a jog shift mechanism to be described later so that the sheet placing tray 42 jog-shifts in the sheet width direction by a predetermined amount with respect to the tray stand 41.

(Tray Elevation Unit)

FIG. 8 shows an elevation unit E of the stacking tray 40. A guide rail 43 (see FIG. 8) is disposed vertically in the stacking direction in the device frame F. A slide roll 44 fixed to a connection section (joint plate) of the tray stand 41 is fitted to the guide rail 43. The guide rail 43 is formed of a rod-like guide, channel steel, H-section steel, and the like. The tray stand 41 is fitted to the guide rail 43 in a slidable manner.

The tray stand 41 has a frame structure which is strong enough to support the load of the sheet placing surface 42 and sheets stacked on the sheet placing surface 42. The tray stand 41 is cantilever-supported by a guide rail which also represents firmness like the tray stand 41. The device frame F is provided with a suspension pulley 45*a* which has a shaft fixed to an upper end section of the guide rail 43 and a hoist pulley 45*b* which has a shaft fixed to a lower end section of the guide rail 43. An extension member 45*c*, such as a wire or a toothed belt, is bridged over both of the pulleys. The hoist pulley 45*b* is connected to a hoist motor MM with a deceleration mechanism provided between them.

At the same time, a coil spring 46 for reducing weight is bridged between the tray stand 41 and the device frame F. That is, a first end (lower end section in FIG. 8) of the spring 46 is fixed to the device frame F, and a second end (upper end section in FIG. 8) is fixed to the tray stand 41 through an extension pulley 47. An initial tension is provided to the spring 46. Accordingly, the weight of the sheet placing tray 42 and the sheets stacked on the sheet placing tray 42 is reduced in accordance with an elastic force of the coil spring 46, and the load torque of the hoist motor is reduced. Alternatively, there may be employed a weight reduction mechanism, in which a weight is hung from a hanging pulley, in place of the coil spring.

(Sheet Placing Tray)

As shown in FIG. 8, the sheet placing tray 42 includes a sheet placing surface 42*a* on which sheets delivered from the sheet discharge port 13 in an upper direction are placed in layers. The sheet placing surface 42*a* may have a horizontal posture; however, the sheet placing surface 42*a* is normally preferably inclined at a predetermined angle, so that the posture of stacked sheets is corrected by allowing the sheets to slide to a rear end side of the sheets by their own weight. Normally an inclination angle of the sheet placing surface 42*a* is appropriate within a range of around 30 to 45 degrees with respect to a horizontal line. If the inclination angle is smaller than or equal to 30 degrees, prompt alignment of sheets which are discharged at high speed becomes difficult. If the inclination angle is larger than or equal to 45 degrees, a curled sheet may be rounded and fall when entering the tray.

The sheet placing tray 42 constituting the stacking tray 40 is supported by the tray stand 41, and moves vertically along the guide rail 43. A fence plate 48 having a rear end regulation surface 48*f* that regulates a rear end section of sheets is disposed in the device frame F. The fence plate 48 may have a wall surface structure fixed to the device frame; however, the fence plate 48 being illustrated has a structure in which the sheet placing tray is jog-shifted by a predetermined amount in the sheet width direction. For this reason, the fence plate 48 is also configured to be jog-shifted together with the sheet placing tray. This structure will be to be described later.

(Jog Shift Mechanism)

Figure 9:
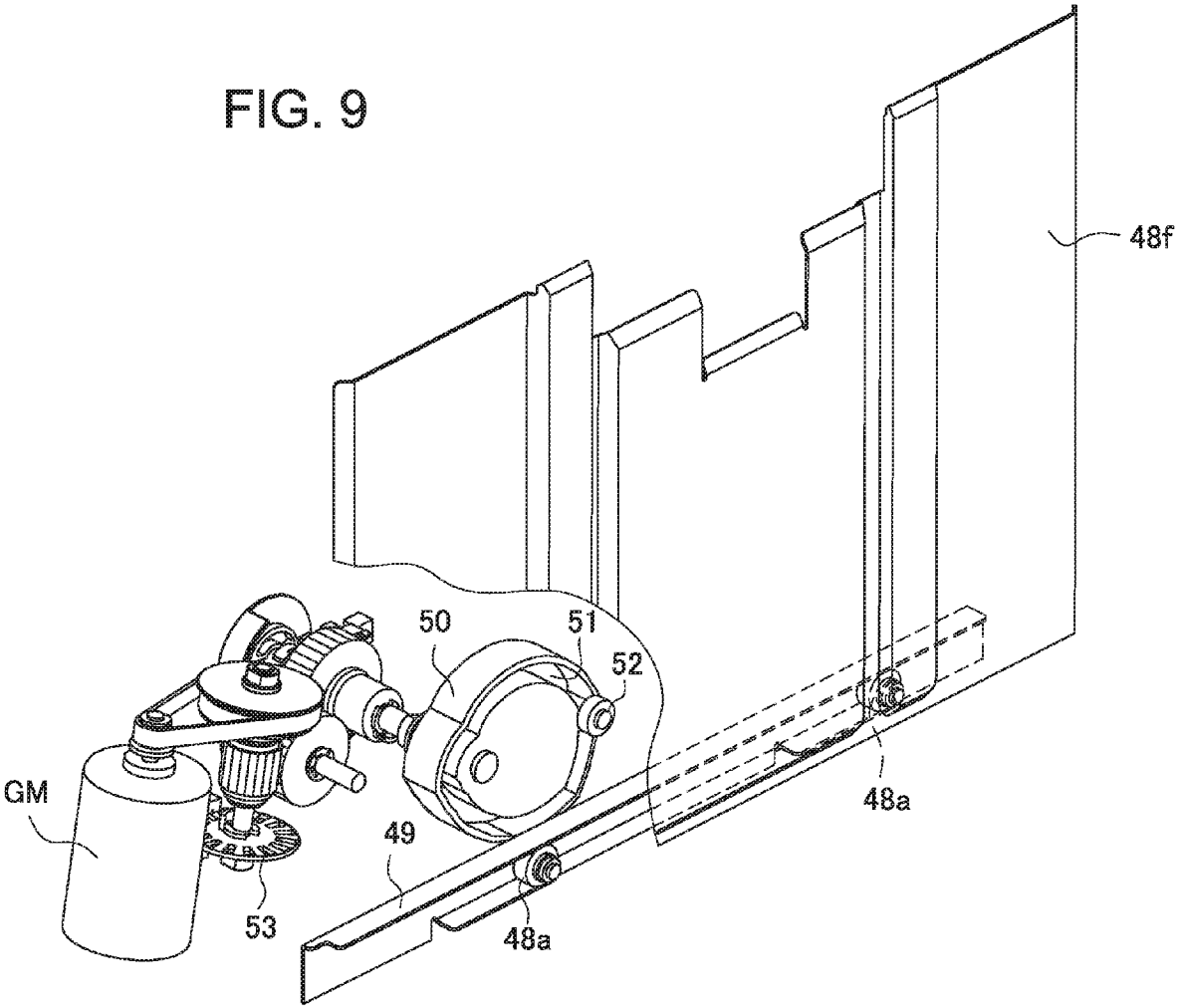
FIG. 9 is an explanatory view of a jog shift mechanism of the stacking tray.

Next, description will be given of the jog shift mechanism of the sheet placing tray 42 supported by the tray stand 41 shown in FIG. 9. In the diagram, the sheet placing tray 42 is positioned on a front side (front surface side) of the diagram, and the device frame F is positioned on a rear side (rear surface side). In this layout, the sheet placing tray 42 is fitted to and connected with the fence plate 48 at recess and projecting portions in a manner movable in a horizontal direction (sheet width direction) of the diagram. That is, the projecting portion is formed on either one of the sheet placing tray 42 and the fence plate 48, and the recess portion is formed on the other one, and both the portions are fitted (dovetail tenon fitting, or the like) and integrated. A slide roll 48*a* is provided on the fence plate 48, and is fitted to and supported by a lateral guide rail 49. The lateral guide rail 49 is fixed to the device frame F in the sheet width direction.

When either one of the fence plate 48 and the sheet placing tray 42 is moved in the sheet width direction in the above configuration, both of them simultaneously move in the same direction by the same amount. In the illustrated device, a jog shift motor GM and a cam member 50 connected to the motor are disposed in the device frame F. A cam pin 52 is fitted to a cam groove 51 formed on the cam member 50 (the illustrated one is an eccentric cam), and the cam pin 52 is integrally implanted in the fence plate 48. An encoder 53 is disposed on a rotation shaft of the jog shift motor GM described above, so that the rotation angle is controlled. A home position sensor (not shown) is disposed on the motor rotation shaft.

When the jog shift motor GM is rotated by a predetermined angle, the cam member 50 connected to the motor GM is rotated by a predetermined angle (the illustrated one is an eccentric cam). The cam pin 52 fitted to the cam groove 51 moves the fence plate 48 integral with the cam pin 52 in the sheet width direction by a predetermined amount. By this movement, the sheet placing tray 42 also moves in the same direction in an integral manner.

(Sheet Surface Level Detection Mechanism)

Figure 10:
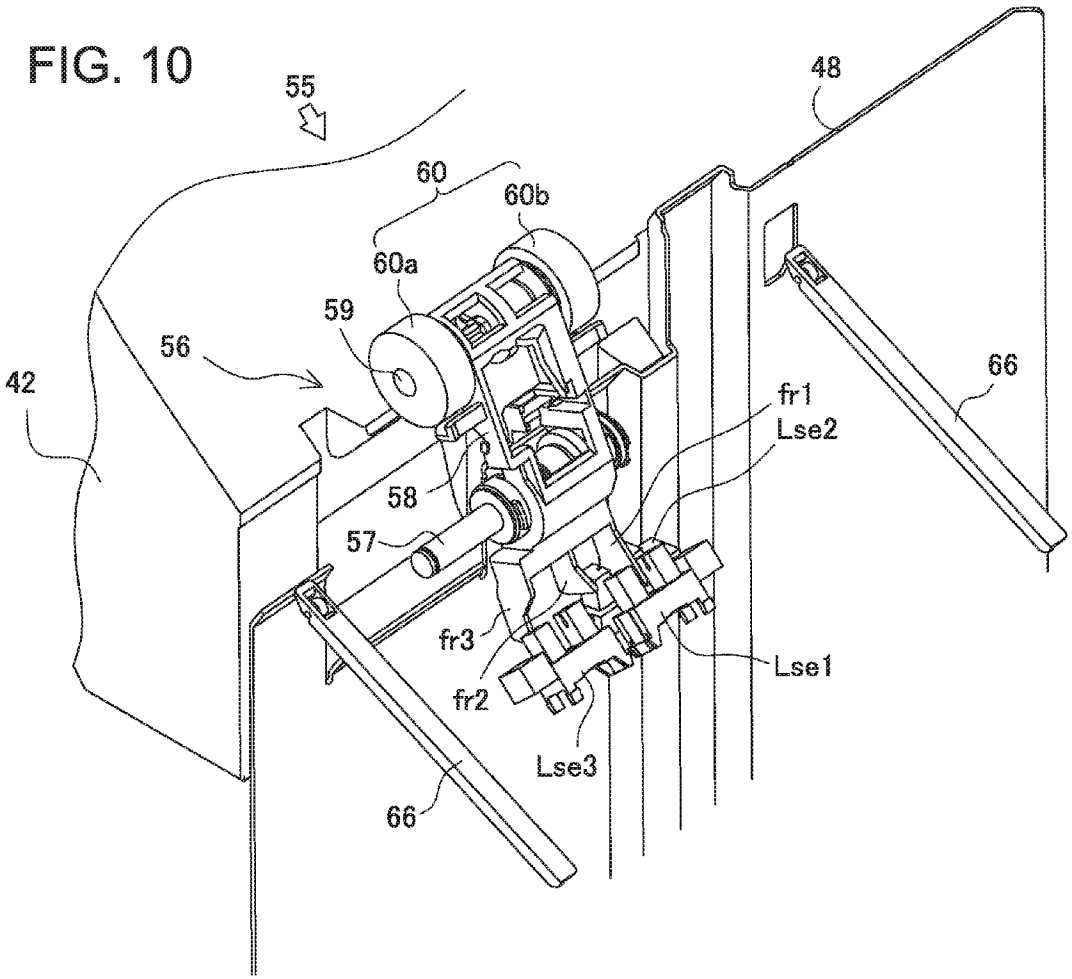
FIG. 10 is a perspective configuration explanatory view of the sheet pressing unit of the stacking tray.
Figure 13A:
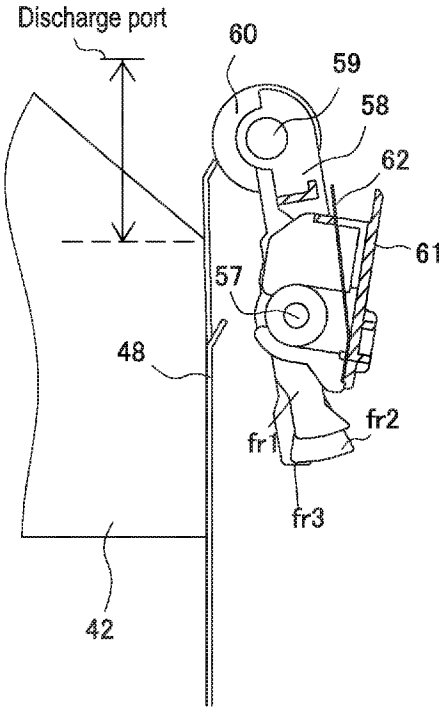

On the stacking tray 40 described above, there are disposed a level detection mechanism 55 that detects a height position of a surface of stacked sheets and a sheet rear end support mechanism 65. The level detection mechanism 55 detects a height level of a surface of a top one of sheets stacked on the sheet placing tray 42. As shown in FIG. 10 illustrating a perspective configuration of the level detection mechanism 55, the level detection mechanism 55 is configured to emerge in the sheet placing tray 42 at a standby position (state of FIG. 13A) where a sheet pressing unit 56 is retracted from above the sheet placing tray 42 and actuation positions (states of FIGS. 13B and 13C) where the sheet pressing unit 56 is in engagement with a top sheet on the tray.

That is, the level detection mechanism 55 waits at the standby position where the level detection mechanism 55 is retracted from a trajectory of a sheet from when the sheet drops from the sheet discharge port 13 located above until when the sheet is stored on the sheet placing tray 42. Before the sheet is discharged, or after the sheet is stored on the tray, the level detection mechanism 55 is in engagement with a surface of a top sheet to detect a height position. In this case, sheets stacked on the tray are sometimes at a higher level than an actual height due to influences of curled sheet, an air layer between sheets, and staples to be described later. Accordingly, the level detection mechanism includes a pressing unit that presses a surface of sheets. In the illustrated device, the pressing unit has a configuration to be described below as a sheet pressing unit 56.

A swing rotation shaft 57 is bearing-supported by the device frame F, and a base end section of a swinging arm 58 is supported by the rotation shaft in a swingable manner. A roller rotation shaft 59 is supported at a front end section of the swinging arm 58, and a frictional rotator 60 (sheet pressure members 60*a* and 60*b*; the same applies hereinafter) is fixed to the rotation shaft.

The swing rotation shaft 57 and the swinging arm 58 are set to have an arm length for swinging the frictional rotator 60 between a detection position above the tray and a standby position outside the tray across the fence plate 48. The illustrated frictional rotator 60 is comprised of a pair of left and right roller bodies arranged at a distance from each other. This is for raking sheets stored in the tray by allowing a rear end of the sheets to abut on the rear end regulation surface 48*f* by rotating the pair of rollers. For this reason, a drive pulley is provided in the swing rotation shaft 57 to drive the frictional rotator 60, and a roller drive motor RM2 (see FIG. 11) is connected to the pulley by a transmission belt 60V.

Figure 11:
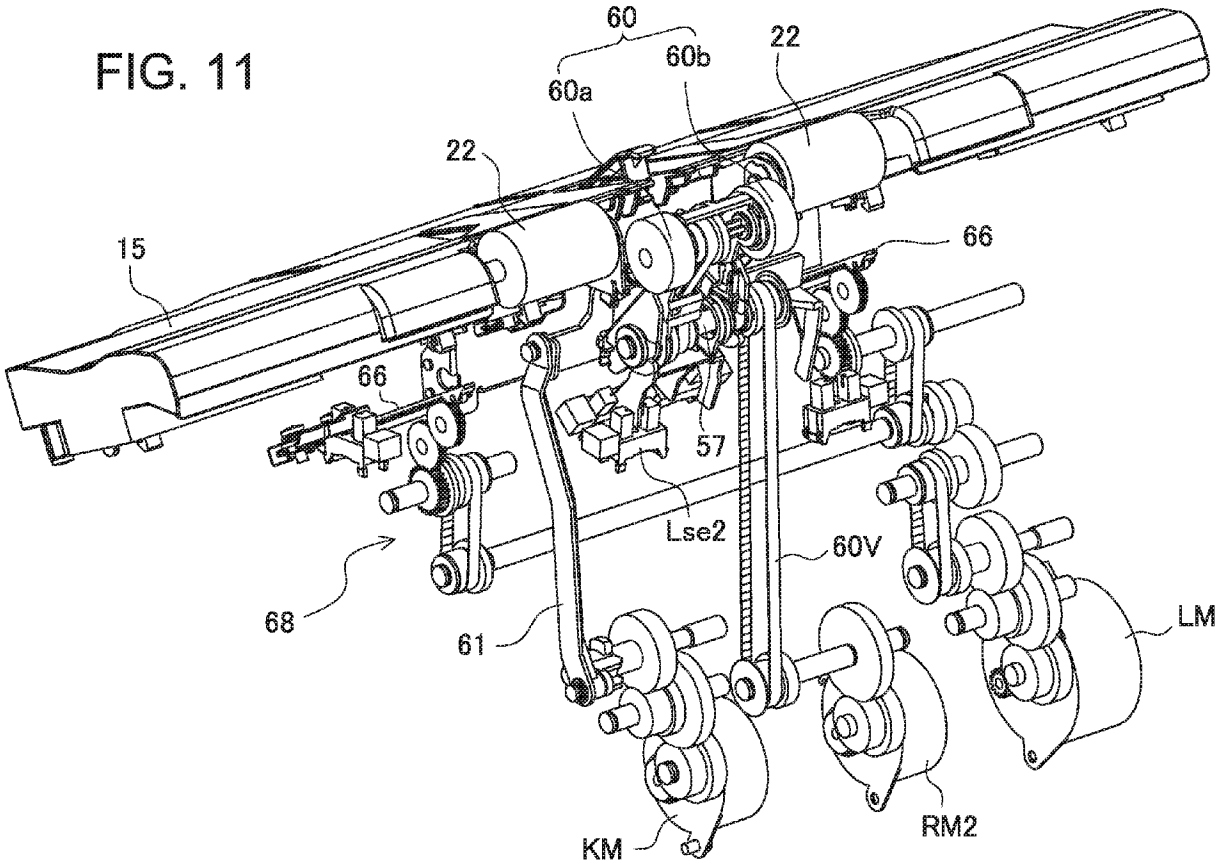
FIG. 11 is an explanatory view of a drive mechanism of the stacking tray, which shows a drive mechanism of a sheet rear end support lever, a drive mechanism of a frictional rotator of the sheet pressing unit, and a drive mechanism that shifts a posture of the sheet pressing unit.
Figure 13B:
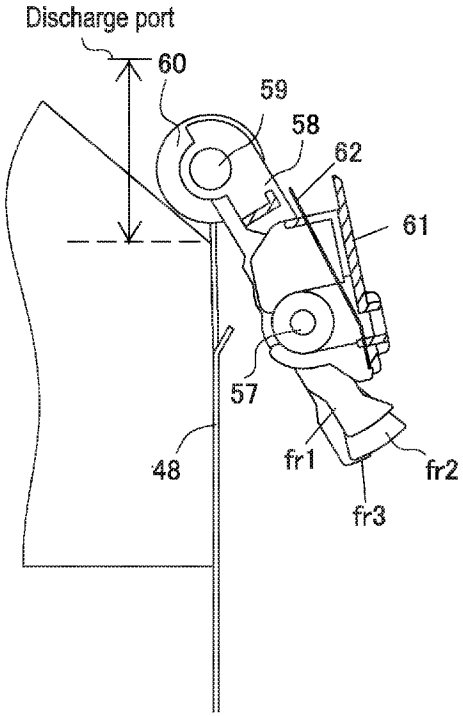
Figure 13C:
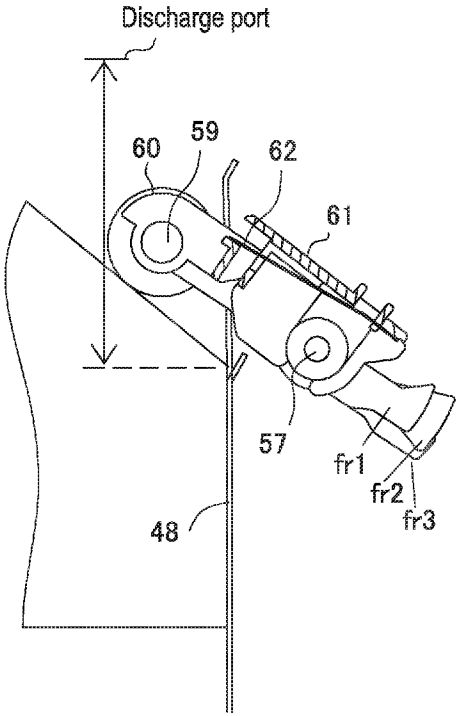

As shown in FIG. 11, the sheet pressing unit 56 is disposed below the inversion roller 20 (the lower roller 22 of the inversion roller 20) provided in the sheet discharge port 13. The sheet pressing unit 56 is constituted by a swinging mechanism that moves from an outer side of a sheet storing trajectory between the sheet discharge port 13 and a surface of a top sheet onto a sheet surface. The illustrated mechanism includes the swinging arm 58 (roller bracket or the like) that can swing about the swing rotation shaft 57 and the frictional rotator 60 (raking roller body; hereinafter referred to as a roller body) that is bearing-supported by the arm member in a rotatable manner. The illustrated roller body 60 is configured by a pair of roller bodies 60*a* and 60*b* at a distance from each other in the sheet width direction. The roller body 60 mounted on a front end of the swinging arm 58 reciprocates between the standby position (FIG. 13A) at which the roller body 60 is positioned on an inner side of the rear end regulation surface (fence plate) 48*f* and a sheet surface engaging position (the detection positions; FIGS. 13B and 13C) at which the roller body 60 is in engagement with a surface of a top sheet on the sheet placing tray 42 by a swing motion of the swinging arm 58.

A press lever 61 is loosely fit to the swing rotation shaft 57 with a collar member provided between them. A sheet pressing motor KM shown in FIG. 11 is connected to the press lever 61. A pressing spring 62 is fixed to the press lever 61, and a front end of the spring is disposed at a position at which the spring is in engagement with the swinging arm member 58. Accordingly, when the sheet pressing motor KM is rotated within an angular range set in advance, the press lever 61 is rotated from the state of FIG. 13A to the state of FIG. 13B. At this time, a spring pressure of the pressing spring 62 is set to an angle at which the pressing spring 62 does not act on the sheet pressing unit 56, and the sheet pressing unit 56 (the roller body 60 and the swinging arm member 58) presses a surface of a top sheet by its own weight. Hereinafter, this state will be referred to as a low pressure state.

When the sheet pressing motor KM is further rotated in the same direction by a predetermined angle, the press lever 61 is rotated from the state of FIG. 13B to the state of FIG. 13C. At this time, the pressing spring warps with its spring force acting on the swinging arm member 58. The roller body 60 then presses a surface of a top sheet in a state where a spring force is added to its own weight. The spring force at this time is set to an energizing force by which swelling, elevation, undulation, and the like of sheets stacked on the sheet placing tray 42 are restricted.

The frictional rotator 60 is comprised of a rubber roller, a resin roller, or the like. When the frictional rotator 60 is in engagement with a surface of a top sheet in the low pressure state described above, the drive force of the roller drive motor RM2, which provides a carrying force for transferring the sheet to the rear end regulation surface 48*f* side, is transmitted by the transmission belt 60V.

(Sensor Structure)

In the sheet pressing unit 56 configured by a rotator as described above, a flag fr for detecting an angle is provided in the swing rotation shaft 57. In the diagram, there are provided a first flag fr1, a second flag fr2, and a third flag fr3 since a height position of the sheet placing tray 42 is set to a first storing height position H1 and a second storing height position H2. The flags fr1, fr2, and fr3 enables detection of whether the sheet surface height of the sheet placing tray 42 is positioned at the first storing height position H1 or the second storing height position H2 set in advance, or at a position higher or lower than these positions.

Description has been given of the configuration of the sheet pressing unit comprised of the swinging arm 58 and the frictional rotator 60 mounted on the swinging arm 58. The present invention, however, is not limited to the above configuration, and the sheet pressing unit may be comprised of, for example, a sheet pressing pad and a swinging arm that moves the pad from a standby position to a detection position.

Hereinafter, description will be given of sheet discharge modes for storing sheets on the stacking tray 40, position control of a tray height in each of the sheet discharge modes, and a height detection method.

(Sheet Discharge Mode)

Next, description will be given of sheet discharge modes for sheets carried from the sheet discharge port 13 to the stacking tray 40 in the present invention. A control unit 85 to be described later includes a first sheet discharge mode and a second sheet discharge mode. The first sheet discharge mode is a sheet discharge operation for discharging a sheet sent to the sheet carrying path 11 onto the sheet placing tray 42 through the sheet discharge port 13. In the first sheet discharge mode, a straight sheet discharge operation, in which sheets delivered from the sheet discharge port 13 are discharged without alignment and offsetting of sheets delivered from the sheet discharge port 13, and a jog sheet discharge operation, in which sheets from the sheet discharge port 13 are offset for each set and discharged onto the tray, are selectively executed.

In the second sheet discharge mode, sheets sent to the sheet carrying path 11 are sent to the sheet discharge port 13, and then to the processing tray 15, where the sheets are aligned for each set, and applied with binding processing. At this time, corner binding processing for binding a corner of the sheets with a staple and center binding processing for stapling two locations in a center section of sheets are selectively executed.

The control unit (control CPU; the same applies hereinafter) 85 to be described later sets a top sheet height of the stacking tray 40 to the "first storing height position H1" to be described below for the straight sheet discharge operation and the jog sheet discharge operation in the first sheet discharge mode, and sets a height position of a top sheet surface of the stacking tray 40 to the "second storing height position H2" to be described below for the corner binding operation and the center binding operation in the second sheet discharge mode.

The control unit 85 controls a sheet sent to the sheet discharge port 13 of the sheet carrying path 11 to settle at a binding position of the processing tray 15 when the second sheet discharge mode is executed. At this time, the control unit 85 adjusts a top sheet surface of the stacking tray 40 to the "first storing height position H1" to be described below.

Figure 7:
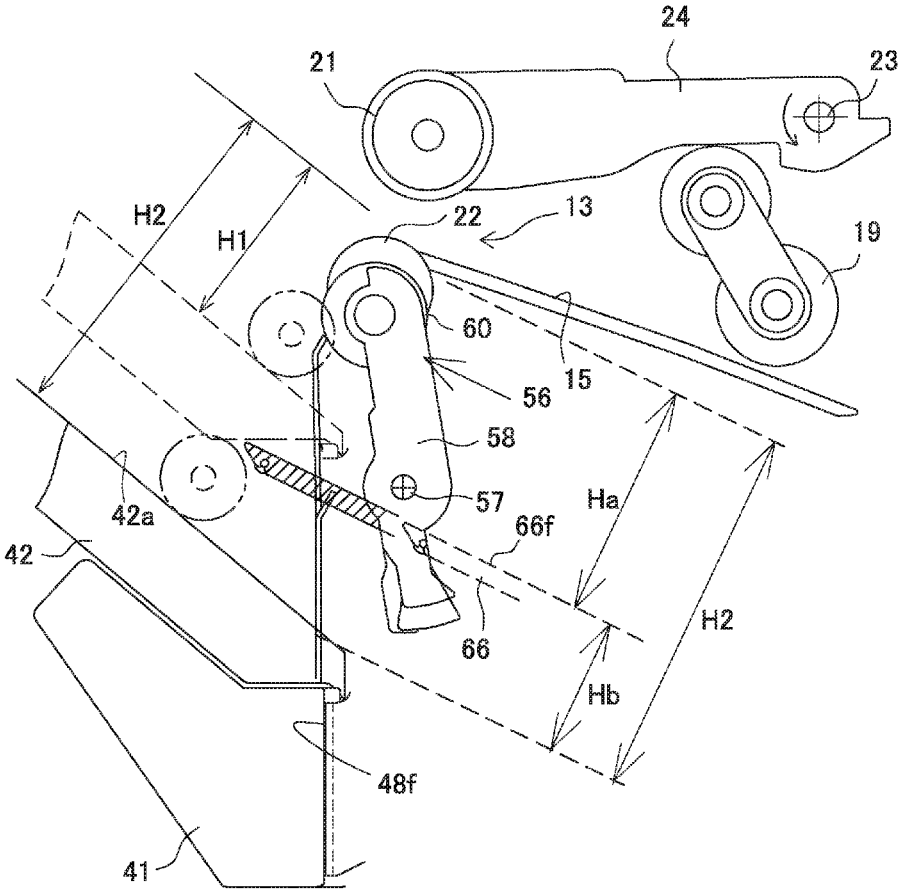
FIG. 7 is a state explanatory view of a sheet pressing unit that detects a height position of a stacking tray in the post-processing device in FIG. 2.

Next, description will be given of the first storing height position H1 and the second storing height position H2 in accordance with FIG. 7. The "first storing height position H1" is set to a position at which a height difference ΔH1 is formed between the sheet discharge port and a top sheet surface (top sheet surface; the same applies hereinafter) of the sheet placing tray 42. The height difference ΔH1 is set to a height level (height difference) of a plurality of stacked sheets by using a sheet sent to the sheet discharge port 13 as a reference point. When the height difference ΔH1 is set to be high (large), the posture of stored sheets sometimes collapses due to the height difference. In contrast, when the height difference is set to be low (small), lowering operation of the tray needs to be executed frequently. Accordingly, an optimum value for a height difference of the "first storing height position H1" is set through experiments and the like based on a frequency of lowering operation of the tray and a storing and aligning property of sheets.

At the "second storing height position H2", a sheet bundle formed by binding processing is dropped from the processing tray 15 onto a top sheet on the sheet placing tray 42. For this reason, a height difference ΔH2 between the sheet discharge port 13 and a top sheet surface is set to be larger than a permissible maximum bundle thickness Hmax of a sheet bundle formed by binding processing on the processing tray. The height difference ΔH2 is set in consideration of, for example, variations of loading amount (variations of stacked sheets, such as an air layer between stacked sheets, wave-like undulation deformation, and curling) by using the permissible maximum bundle thickness Hmax (device specification) as a reference point. In particular, when stapled sheet bundles are stacked on the sheet placing tray 42 (at the time the second sheet discharge mode to be described later is executed), there is generated a phenomenon in which the piled sheets become swollen because of accumulation of the stapled parts. In view of uneven sheet surfaces of sheet bundles stacked on the sheet placing tray 42, the "second storing height position H2" is set to the height difference ΔH2 which is sufficiently larger than the permissible maximum bundle thickness Hmax.

The rear end support mechanism 65 having a configuration to be described below that supports a rear end of a dropping sheet bundle is disposed between the "second storing height position H2" described above and the sheet discharge port 13 of the processing tray 15. Description will be given of a relationship between a rear end support member 66 of the rear end support mechanism 65 and the first storing height position H1 and the second storing height position H2 in accordance with FIG. 7.

The "second storing height position H2" has the height difference ΔH2 from the sheet discharge port 13. The rear end support member 66 that supports a rear end of a sheet bundle is disposed at an intermediate position in the range of the height difference ΔH2 in a manner that the rear end support member 66 can emerge above the sheet placing tray 42. A support surface 66*f* that supports a sheet bundle that drops from the sheet discharge port 13 is provided in the rear end support member 66. A height difference Ha between the sheet discharge port 13 and the support surface 66*f* is set to be larger than the permissible maximum sheet bundle Hmax. At the same time, in the illustrated device, a height difference Hb between the support surface 66*f* and a top sheet surface of stacked sheets is set to be smaller than the permissible maximum sheet bundle Hmax.

That is, when the permissible maximum sheet bundle thickness is Hmax, ΔH2=Ha+Hb, Ha>Hmax>Hb, in which Ha is set to be larger (higher) than the permissible maximum sheet bundle thickness Hmax, so that a sheet bundle dropped from the sheet discharge port 13 is stacked on the support surface 66 without fail. For a sheet bundle that is dropped from the support surface 66*f* onto a top sheet of stacked sheets, the height difference is set to be as small as possible so as to reduce an impact of the dropping.

In the present invention, description has been made on the case where a height position of the stacking tray 40 is controlled in two levels, the first storing height position (H1) and the second storing height position (H2). The height positions are not limited to the two positions, and may be a plurality of positions. For example, a height position of the stacking tray 40 when a sheet is carried onto the processing tray 15 from the sheet discharge port 13 may be set to a height position on the same plane as the sheet placing table 16 of the processing tray 15. Similarly, when a sheet bundle is caused to drop onto and stored on the stacking tray 40, a third storing height position which is higher than the second storing height position H2 can be set up, so that a front end of a discharged sheet bundle can be received on a sheet placing tray surface at the third storing height position, and the sheet bundle is caused to fall to the second storing height position H2 in accordance with discharge of the sheet bundle.

Description will be given of a method of positioning the aforementioned sheet placing tray 42 at the second storing height position H2 described above. As described above, the second storing height position H2 is set to the sum of the height difference Ha between the sheet discharge port 13 and the support surface 66*f* (rear end support member) and the height difference Hb between the support surface 66*f* and a surface of a top sheet on the tray. That is, (H2=Ha+Hb) is established, and "Ha" is set, as a design value, to a value larger than the permissible maximum sheet bundle thickness Hmax, and "Hb" is set to a value smaller than the permissible maximum sheet bundle thickness Hmax as to be described below.

Either of first height position setting which considers a sheet bundle thickness waiting on the processing tray 15 on an upstream side and second height position setting in which the bundle thickness is set to a specified value is employed as a height position of the sheet placing tray 42.

In the "first height position setting", the height difference Hb between the support surface 66*f* and a top sheet surface on the sheet placing tray 42 is set in consideration of a bundle thickness of a sheet bundle which is stacked (or has been stacked) on the processing tray 15. That is, a bundle thickness of a sheet bundle stored within the range of the height level 11*b* is determined, and the height difference Hb is set with reference to the determined bundle thickness. The setting is made in a manner, for example, (height difference Hb)=(thickness of a sheet bundle to be stored)+(clearance gap).

To detect a bundle thickness of a sheet bundle in this case, (1) a bundle thickness detection sensor is disposed on the processing tray 15. The detection sensor detects, for example, a height position of a locking piece (not shown) that is brought into engagement with a surface of a top sheet of a sheet bundle stacked on the processing tray 15. In addition to the above, (2) to detect a bundle thickness of a sheet bundle, the number of sheets carried onto the processing tray 15 is counted by the image formation device A or the sheet discharge sensor Se2, and a total number of sheets is multiplied by an average sheet thickness when a job end signal is issued. As described above, a bundle thickness of a sheet bundle can be determined by either of the methods (1) and (2).

In the "second height position setting", the height difference Hb between the support surface 66*f* and a surface of a top sheet on the sheet placing tray 42 is set to a specified value set in advance. For example, (height difference Hb) (permissible maximum sheet bundle thickness)+(clearance gap) is set.

(Height Position Detection)

As described above, the sheet pressing unit 56 has the swing rotation shaft 57 provided with the flag fr for detecting an angle. For the first flag fr1, the second flag fr2, and the third flag fr3, a first sensor LSe1, a second sensor LSe2, and a third sensor LSe3 for detecting positions of the flags are attached to the device frame F.

Figures 12A, 12B:
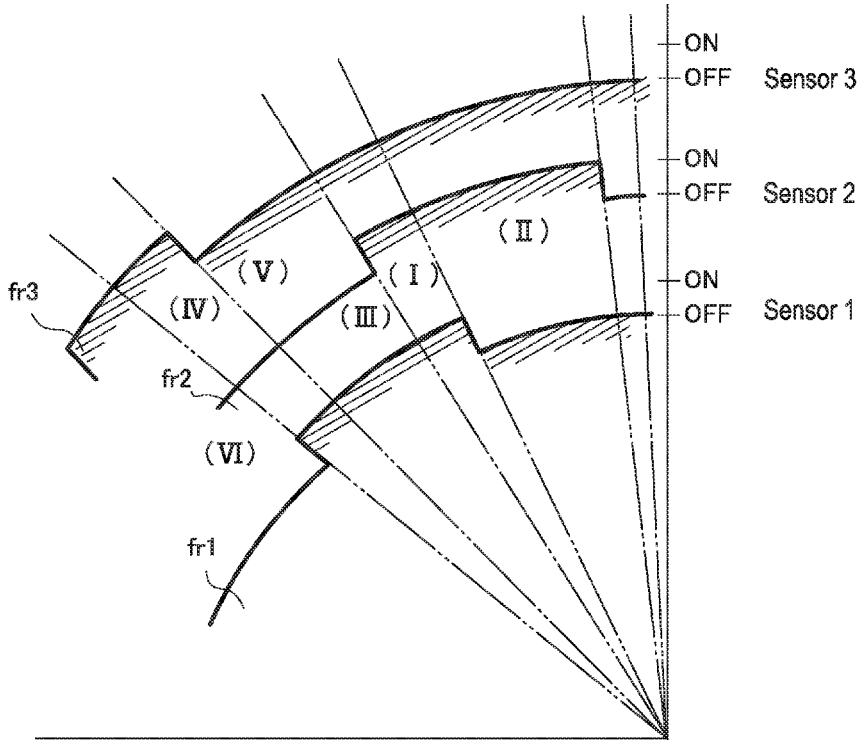

FIGS. 12A and 12B show relationships between rotation angles of the swing rotation shaft 57 and the flags. The first sensor LSe1, the second sensor LSe2, and the third sensor LSe3, which are sensors that detect the three flags, are attached to the device frame F. In positional relationships between the sensors and the flags as shown in FIGS. 12A and 12B, height levels of sheets stacked on the sheet stacking tray are detected based on ON/OFF of the first sensor LSe1, ON/OFF of the second sensor LSe1, and ON/OFF of the third sensor LSe3.

When the first sensor LSe1=OFF, the second sensor LSe2=OFF, and the third sensor LSe3=OFF, the sheet pressing unit 56 is positioned at a standby position (home position; position shown by a solid line in FIG. 7) (the sensor and the flag are disposed at such an angular position). When the first sensor LSe1=OFF and the second sensor LSe2=ON, the sheet pressing unit 56 is positioned higher than the first storing height. When the first sensor LSe1=ON and the second sensor LSe2=OFF, the sheet pressing unit 56 is positioned lower than the first storing height.

Similarly, when the first sensor LSe1=ON and the third sensor LSe3=ON, the sheet pressing unit 56 is positioned at an appropriate position at the second storing height (second level). When the first sensor LSe1=ON and the third sensor LSe3=OFF, the sheet pressing unit 56 is positioned higher than the second storing height. When the first sensor LSe1=OFF and the third sensor LSe3=ON, the sheet pressing unit 56 is positioned lower than the second storing height.

The sheet placing tray 42 is set to the first storing height position H1 when sheets are stored on the sheet placing tray 42 one sheet at a time in the first sheet discharge mode. At this time, a pressing unit (the press lever 61) is held at a non-operating position. The sheet placing tray 42 is set to the second storing height position H2 when a sheet bundle is carried from the processing tray and stored on the sheet placing tray 42 in a second carrying mode to be described later. At this time, the pressing unit (the press lever 61) is held at a pressing position. The frictional rotator 60 rotates to allow a rear end of a sheet which is discharged from the sheet discharge port 13 and stored on a top sheet surface to abut on the rear end regulation surface 48*f* in a first sheet discharge mode to be described later. At this time, the rotator 60 presses a surface of a sheet with a low pressing force (weight of the roller and the swinging arm). In the second sheet discharge mode for discharging a sheet bundle from the processing tray 15, the frictional rotator simply presses (with a high pressing force) a sheet surface in a state where no rotational force is applied to the fence plate 48.

(Sheet Rear End Support Mechanism)

As described above, the illustrated post-processing device B provided the first sheet discharge mode and the second sheet discharge mode. In the first sheet discharge mode, a height difference between the sheet discharge port 13 and a top sheet surface on the sheet placing tray 42 is set to the first storing height position. In the second sheet discharge mode, the height difference H2 between the sheet discharge port 13 and the sheet placing tray 42 is set to the second storing height position (H2; second height Hv2). The first height difference is set to be small, and the second height difference is set to be large (the first storing height position H1<the second storing height position H2).

When a sheet bundle is dropped from the sheet discharge port 13 onto a top sheet surface on the sheet placing tray 42 and stored in the second sheet discharge mode under the above sheet discharge condition, a rear end support mechanism that supports a rear end section of the dropped sheet bundle is disposed at an intermediate position of the height difference. Hereinafter, description will be given of the rear end support mechanism.

Figure 14:
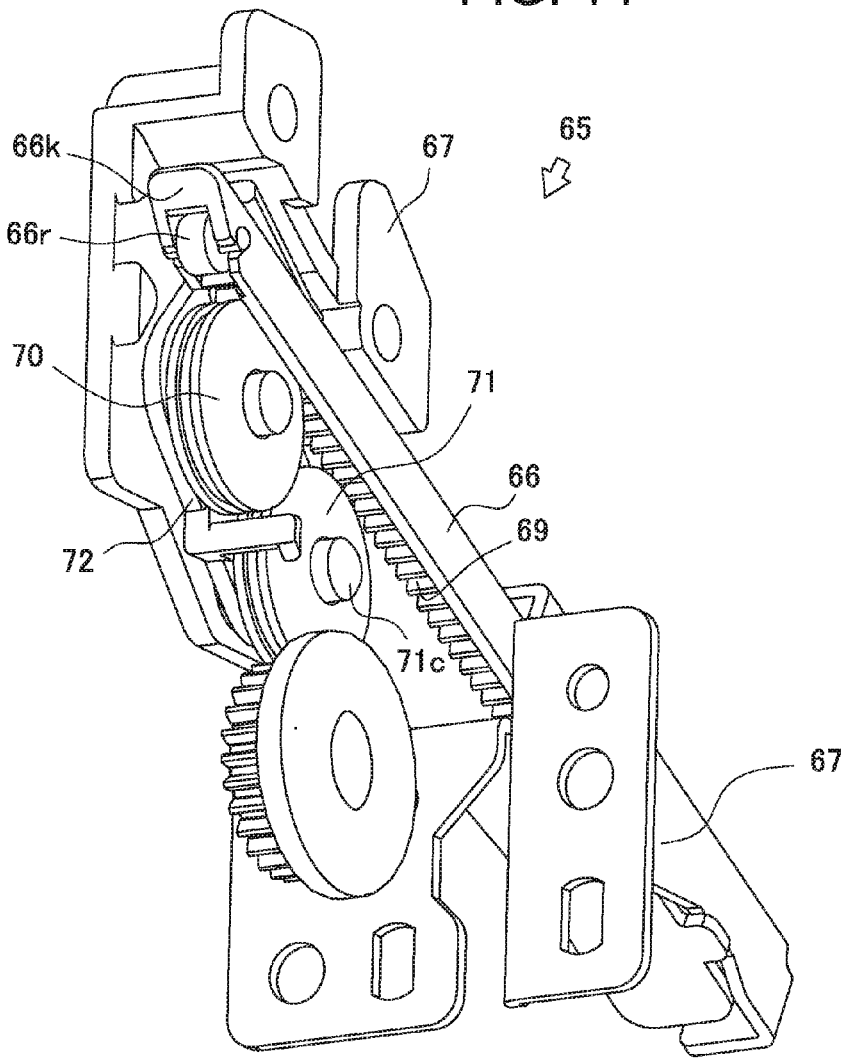
FIG. 14 is a perspective configuration explanatory view of a rear end support member of the stacking tray.

FIG. 14 is a perspective explanatory view of the rear end support mechanism 65, in which a pair of left and right support mechanisms having the illustrated configuration are disposed at a distance from each other in the sheet width direction. The left and right support members have a positional relationship illustrated in FIG. 7, and are disposed on both side sections of the sheet pressing unit 56 described above. Description will be given of one of the support mechanisms in accordance with FIG. 14 (the same applies to the other mechanism).

The rear end support mechanism 65 is comprised of the rear end support member 66 that has the support surface 66*f*, a slide guide member 67 (holder member; the same applies hereinafter) that supports the support member in a movable manner between the standby position Wp at which the support member is retracted from above the sheet placing tray and the actuation position Ap above the tray, and a lever shift unit 68 that moves a position of the support member between the standby position and the actuation position.

The rear end support member 66 temporarily supports a rear end section of a sheet bundle dropped from the sheet discharge port 13. For this reason, the rear end support member 66 is disposed in an intermediate position between the sheet discharge port 13 and a top sheet surface, and includes the support surface 66*f* (also referred to as a support surface) that places/supports a rear end section of a sheet bundle dropped from above. The rear end support member 66 is disposed at a height position set between the sheet discharge port 13 and a top sheet surface (at a distance Ha from the sheet discharge port 13 and at a distance Hb from a top sheet surface as shown in FIG. 7). The rear end support member 66 is fitted to and supported by the slide guide member 67 in a manner movable between the actuation position Ap (shown by a solid line in FIG. 7) above the sheet placing tray 42 and the standby position Wp (shown by a broken line in FIG. 7) at which the rear end support member 66 is retracted to the outside of the tray.

The slide guide member 67 is fixed to the device frame F. When a sheet bundle is discharged from the sheet discharge port 13, the rear end support member 66 moves from the standby position to the actuation position in accordance with the discharge timing, supports a rear end section of the sheet bundle being dropped onto a sheet placing surface from above a sheet surface, and moves from the actuation position to the standby position after supporting the sheet bundle. A sheet rear end section supported on the support surface 66*f* is then stored on a stacked sheet by moving to the standby position.

The rear end support member 66 shown in FIG. 14 is configured by a plate-like lever member having a predetermined width in the sheet width direction, and can enter the tray from the fence plate 48 and retract from the tray. The rear end support member 66 is located at an intermediate position of the height difference H2 between the sheet discharge port 13 and a top sheet surface as shown in FIG. 7. The height Ha in the diagram is set to a distance larger than a bundle thickness maxh of a permissible maximum sheet bundle (Ha>maxh). At the same time, the interval Hb between the support surface 66*f* and a top sheet surface is set to be smaller than the interval Ha between the sheet discharge port 13 and the rear end support member 66. The interval Hb between the support surface 66*f* and a top sheet surface that is set to be smaller than the bundle thickness maxh of a permissible maximum sheet bundle enables soft landing of a rear end section of a sheet supported on the support surface 66*f* on a top sheet on the tray.

The height position of the support member is set as described above for a reason to be described below. If the support surface does not exist, a sheet bundle is dropped from the sheet discharge port 13 in a range corresponding to a height difference (H2=Ha+Hb). Due to an impact of the drop, postures of the fallen sheet bundle itself and a sheet bundle stacked on the sheet placing tray 42 are collapsed in such a manner that positions are shifted and stacked bundles are collapsed. In contrast, if the support surface 66*f* is allowed to exist in an intermediate position (Ha) of the height difference H2, a sheet bundle from the sheet discharge port 13 is first dropped on the support surface at the height difference Ha, and then is dropped on a stacked sheet surface at the height difference Hb. In this manner, an impact of a drop is reduced, and collapse of a dropped sheet bundle and a stacked sheet bundle is prevented.

In view of the above, the illustrated device has the following characteristics: (1) the rear end support member 66 is configured by a plate-like lever member; (2) an angle at which the rear end support member 66 enters the tray is differentiated from an angle at which the rear end support member 66 retracts from the tray; (3) a front end of the rear end support member 66 is formed to have an inclined surface in accordance with a shape of a sheet surface of a sheet bundle on the tray; and (4) a freely movable roller is disposed on the inclined surface. Description will be given of the above configurations.

Figure 15:
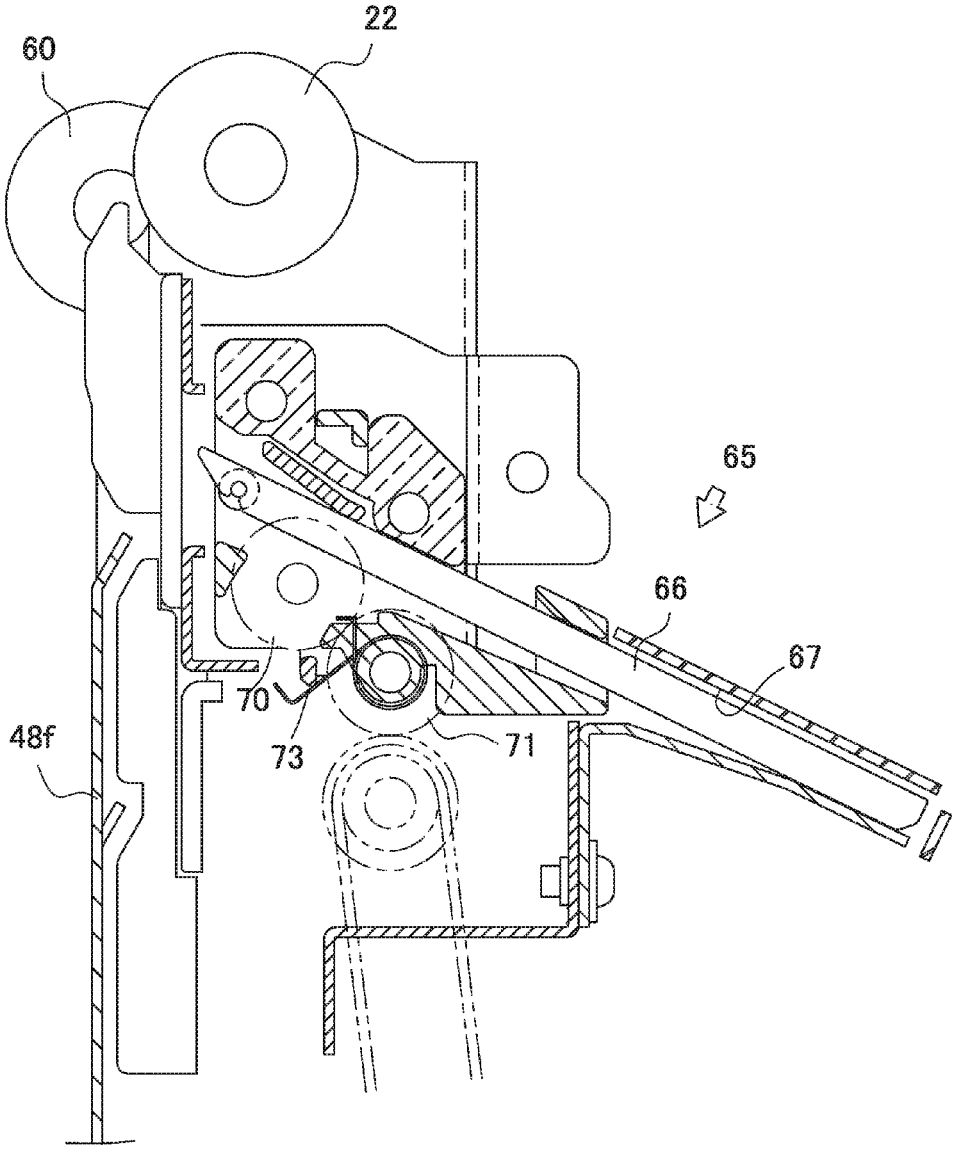
FIG. 15 is an explanatory view of a mechanism that advances or retracts the rear end support member to or from the tray.
Figure 16A:
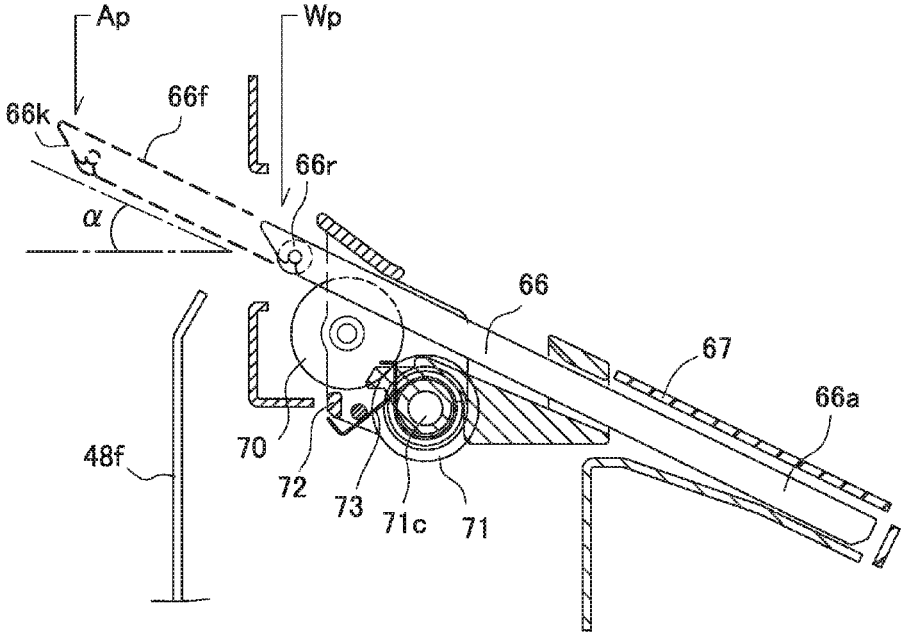
Figure 16B:
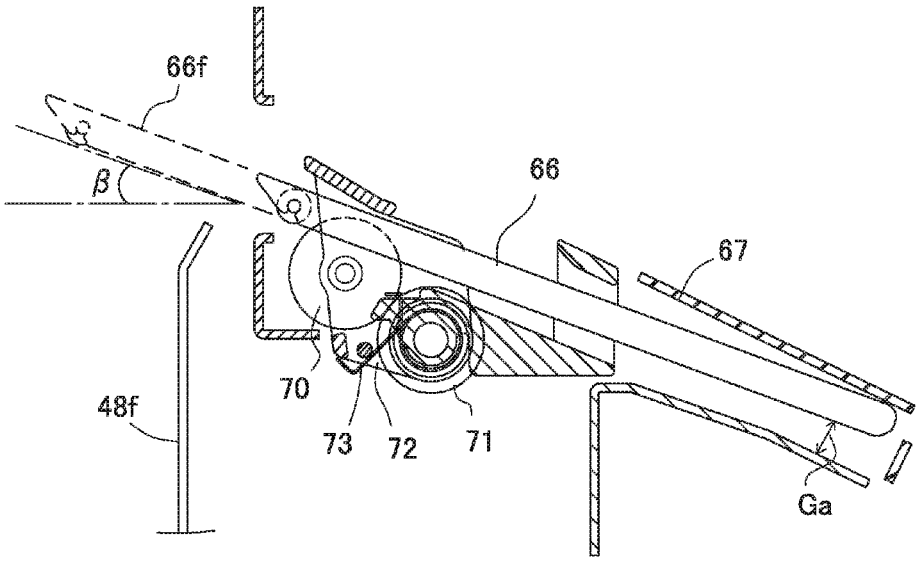
Figure 17:
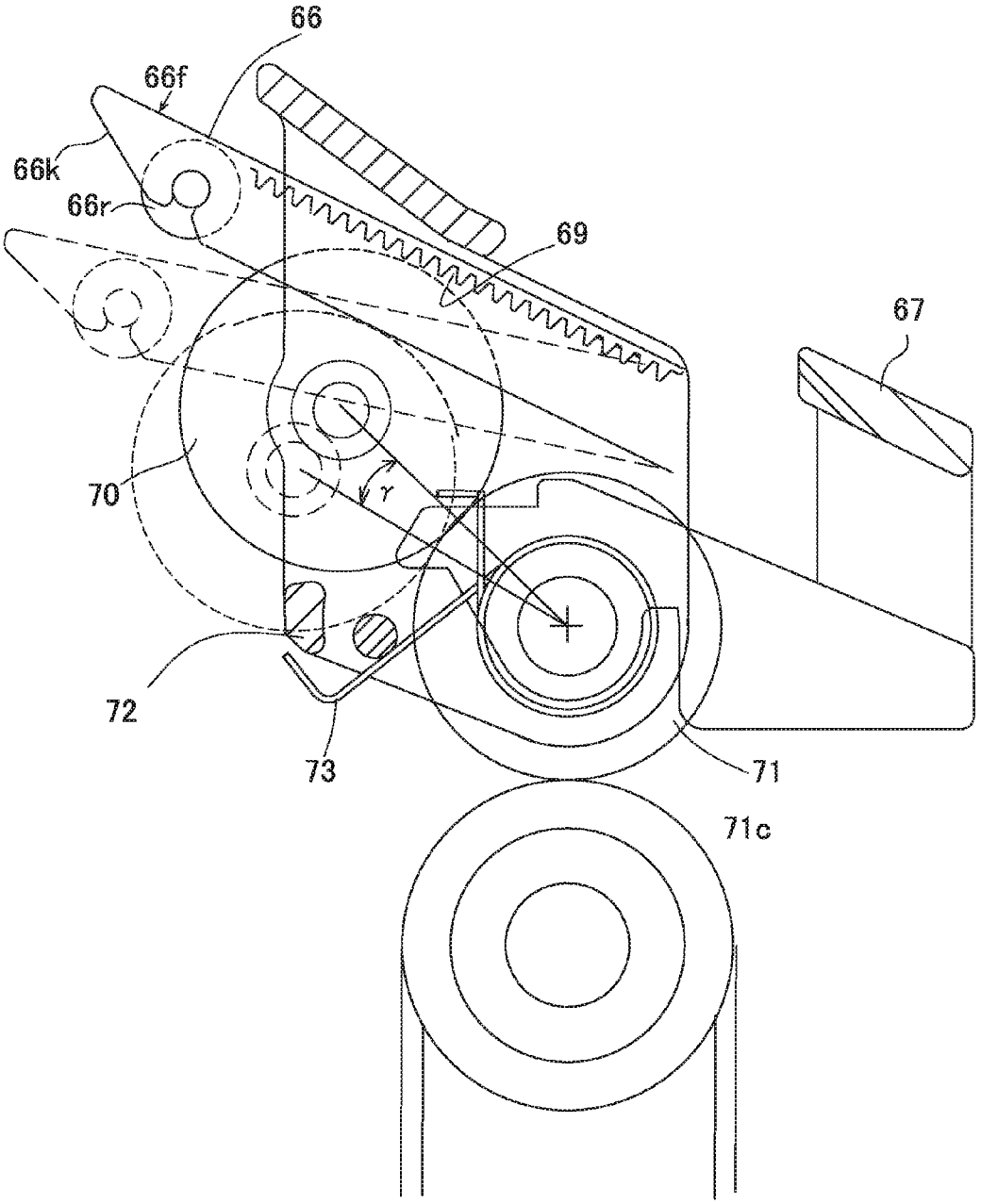
FIG. 17 is an explanatory view showing a planetary gear mechanism that changes an angle of the rear end support member.

FIG. 14 shows a perspective explanatory view of the support mechanism. FIG. 15 is a plan view of an assembly state of the support mechanism. FIGS. 16A and 16B show an operation state of the support member. FIG. 17 shows a state in which the angle of the support member is changed. The rear end support member 66 is configured by a plate-like lever member as shown in FIG. 14. The lever member is supported by the slide guide member 67 (holder member) fixed to the device frame F. As shown in FIGS. 16A and 16B, the lever member 66 moves from the standby position shown by a solid line to the actuation position shown by a broken line in the diagram along the slide guide member 67. For this reason, a rack 69 to be described later is provided in the lever member, and a lever actuation motor LM is connected to a pinion 70 meshed with the rack 69.

The support surface 66*f* (support surface) is formed on a plate-like surface of the lever member 66, and a back surface of the lever member 66 is formed as an inclined surface 66*k*. A base end section 66*a* of the lever member 66 is slidably fitted to and supported by the slide guide member 67 formed on the device frame F, and reciprocates between the actuation position Ap and the standby position Wp by a predetermined stroke.

A gap Ga that allows a swing motion of the lever member is provided in the illustrated slide guide member 67 so as to allow the lever member to make a linear motion by a set stroke as well as a swing motion. The gap Ga is provided to differentiate an angular posture of the lever member 66 between a solid line state (first angular posture; upward angular posture) to a broken line state (friction posture; downward posture) shown in FIG. 17. Accordingly, when the gap Ga between the slide guide member 67 and the lever member 66 is set to be large, an angular difference between a first angle α and a second angle ρ becomes large. In contrast, when the gap Ga is set to be small, the angular difference becomes small.

The rack 69 is formed on a back surface side of the lever member 66 (lower surface side facing a stacked sheet surface). A drive pinion connected to the lever actuation motor LM is connected to the rack 69 through gears. The lever actuation motor LM is mounted on the device frame, and is connected to a drive pinion 71 attached to the frame with a deceleration gear provided between them. The drive pinion 71 is connected to a transmission pinion 70 which is connected to a gear holder 72 in a manner performing a planetary motion within a predetermined angular range (γ; see FIG. 17) as a planetary gear. That is, as shown in FIG. 17, the gear holder 72 is supported by a rotational spindle 71*c* of the drive pinion 71 in a rotatable manner. The transmission pinion 70 has a shaft fixed to the gear holder 72 in a rotatable manner.

Accordingly, the transmission pinion 70 receives rotation transmitted from the drive pinion 71, and transmits the rotation to the rack 69 of the lever member 66. At the same time, the transmission pinion 70 rolls around an outer peripheral of the drive pinion 71 as a planetary gear. A biasing spring 73 that biases the lever member 66 in the first angular posture (FIG. 16A state) is provided on the gear holder 72. The biasing spring 73 has one end locked on the gear holder 72 and the other end locked on the device frame F.

The biasing spring 73 constantly biases the support member 66 to the first angular posture. The biasing spring 73 is set to have a spring pressure, by which the rear end support member 66 is changed from the first angular posture to the second angular posture with a weight of a sheet bundle. The biasing spring 73 is designed in a manner that, for example, a sheet weight applied by a rear end section of a sheet bundle which has average sheet size, grammage, and bundle thickness exceeds a spring pressure of the biasing spring 73.

A front end section of the lever member 66 is formed into a shape in accordance with a surface of sheets stacked on the sheet placing tray 42 (FIG. 17 shows an enlarged state, in which a sheet surface angle of a rear end section of a top sheet and an inclined surface of a lever front end section are in a substantially parallel angular relationship). That is, in a front end section of the lever member 66, there is formed the inclined surface 66*k* having an acute shape, and the inclination angle of the inclined surface 66*k* is set to an inclination angle α (FIG. 16A) at which the inclined surface 66*k* approaches upward toward a top sheet stacked on the sheet placing tray 42 when the lever member 66 is in the first angular posture. This state is shown in FIG. 16A. The inclination angle is so set because, when the lever member 66 enters the tray in the first angular posture, and a top sheet is curled, the lever member 66 is guided to a freely movable roller 66*r* along an inclined surface of the lever without pressing out the sheet.

If the lever member 66 retracts from the tray in the second angular posture, the inclination angle β of the lever member 66 (FIG. 16B) retracts in an angular direction which is almost the same as a sheet surface shape of a stacked top sheet, which generates an action of pulling the top sheet in the retracting direction (a height difference between a sheet bungle and a top sheet can be set to be minimum by the inclination angle β). When a top sheet is moved in a lever retracting direction at the time the lever member 66 retracts, a sheet rear end edge abuts on the rear end regulation surface 48*f* (fence plate), and the position of the sheet rear end edge is regulated.

The plate like lever member 66 can be formed to have the same width as a sheet bundle in a width direction. However, if a contact area with a sheet bundle is made large, a load of entering the tray and a load of retracting from the tray are increased. In contrast, the function of locking and holding a rear end of a sheet bundle above a sheet surface of a top sheet is not greatly influenced by the width of the lever member 66.

That is, the width and shape of the lever member 66 is determined based on a friction load applied when the lever member 66 enters or retracts from the tray, a holding function for supporting a sheet bundle rear end, and space efficiency. The left and right plate-like lever members 66 are disposed in two locations in the vicinity of a stapled position in the sheet bundle width direction with a gap between them. As described above, by supporting the vicinity of the stapled position, contact between a sheet bundle and the stapled position can be prevented and generation of a scar can be reduced even when the stapled position is raised. Alternatively, a position away from the stapled section in the sheet width direction may be supported. In the diagram, the sheet pressing unit 56 (the frictional rotator 60) described above is disposed in a sheet center, and a pair of the left and right lever members 66 having the same configurations are disposed on both side sections of the sheet pressing unit 56. The rear end support member 66 is not limited to a plate-like member, and a plate member having an appropriate shape that supports a rear end section of a sheet bundle can be employed. The rear end support member 66 can also be disposed in a plurality of locations, two locations or more, along a sheet rear end edge.

(Function of Rear End Support Member)

Figure 18A:
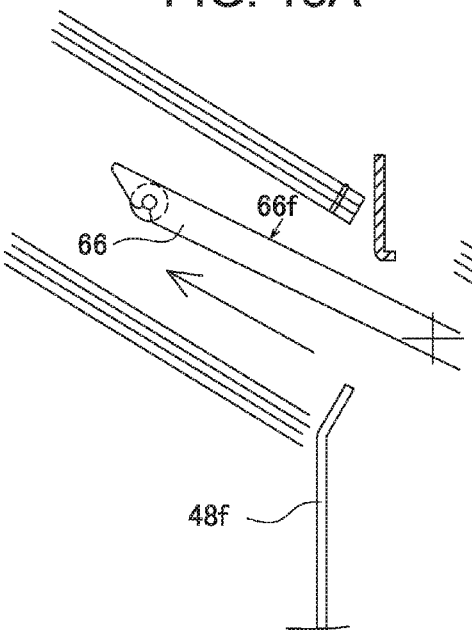

Description will be given of a function of the rear end support member 66 in accordance with FIGS. 18A to 18D. FIG. 18A shows a state in which the support member 66 enters the sheet placing tray 42 and a sheet bundle is dropped from the sheet discharge port 13 located above. In this state, the rear end support member 66 enters above the tray 42 at the first angle α (in an upward posture). At this time, even if a top sheet on the tray curls upward and bends back, the inclined surface 66*k* guides the curled sheet in the freely movable roll 66*r* direction, and the rear end support member 66 enters the tray without collapsing a posture of the sheet.

Figure 18B:
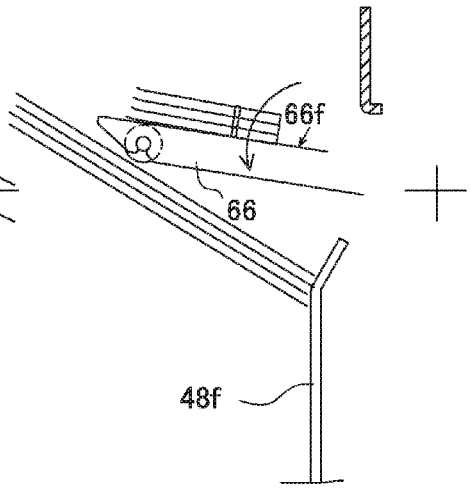
Figure 18C:
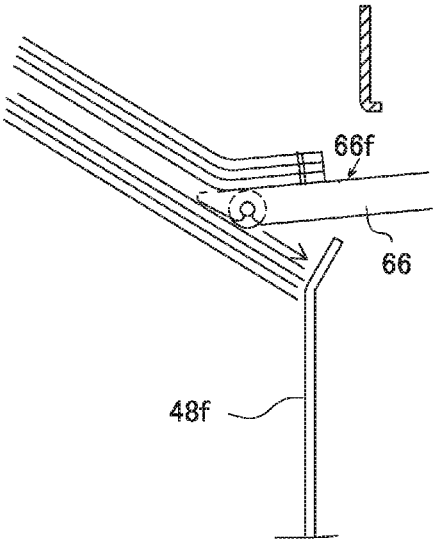

FIG. 18B shows a state in which a sheet bundle is dropped on the support surface 66*f* of the rear end support member 66. The support member 66 swings by a weight of the sheet bundle in such a manner as falling on a top sheet against the biasing spring 73. The support surface at this time is in the second angular posture at angle β. FIG. 18C shows a state in which the rear end support member 66 is retracted from the actuation position to the standby position in the second angular posture. At this time, the inclined surface 66*k* and the freely movable roll 66*r* at a front end of the rear end support member 66 pulls a top sheet stacked on the tray in a manner that the top sheet abuts on the rear end regulation surface 48*f*.

Figure 18D:
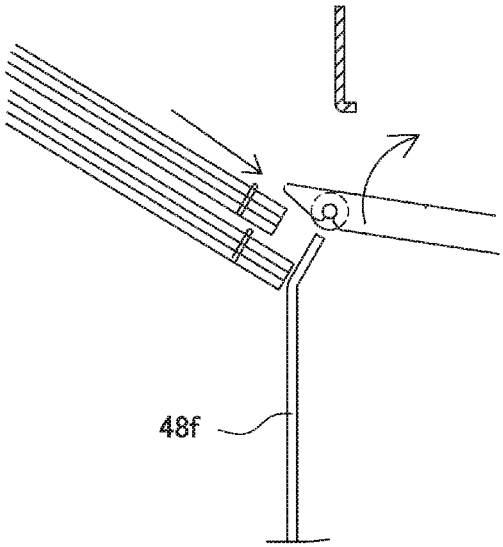

FIG. 18D shows a state in which the support member 66 retracts from the rear end regulation surface 48*f* to the standby position. At this time, the rear end support member returns from the second angular posture to the first angular posture. The reciprocating movement of the support member 66 between the standby position and the actuation position is implemented by forward and reverse rotations of the lever actuation motor LM described above.

(Control Configuration)

Figure 19:
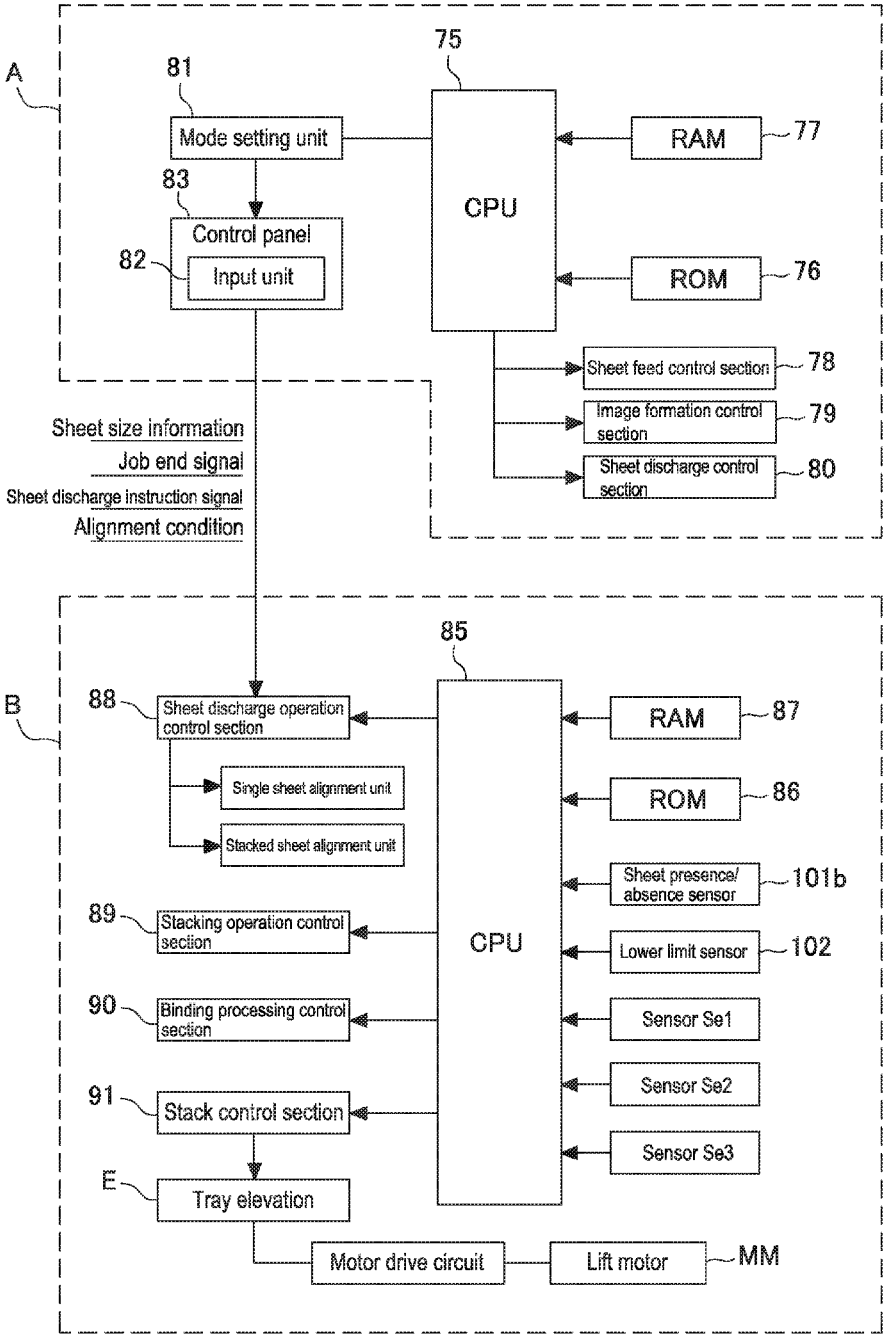
FIG. 19 shows an explanatory view of a control configuration of the image formation system of FIG. 1.

Description will be given of a control configuration of the image formation system shown in FIG. 1 in accordance with FIG. 19. A control CPU 75 is provided in the image formation device A. The control CPU 75 is connected to a ROM 76 that stores an operation program and a RAM 77 that stores control data. The control CPU 75 is provided with a sheet feed control section 78, an image formation control section 79, and a sheet discharge control section 80. At the same time, the control CPU 75 is connected to a mode setting unit 81 and a control panel 83 including an input unit 82.

The control CPU 75 is configured to select "print-out mode", "jog mode", and "post-processing mode". In the "print-out mode", a sheet on which an image is formed is stored on the stacking tray 40 without being subject to finishing processing. In the "jog mode", sheets on which an image is formed are offset and stored in the stacking tray 40 so that the sheets can be aligned and sorted into sets. In the "post-processing mode", sheets on which an image is formed are aligned for each set and stacked, and stored on the stacking tray 40 after binding processing is performed.

The post-processing unit B is provided with the post-processing control CPU 85, and is connected to a ROM 86 that stores a control program and a RAM 87 that stores control data. To the post-processing control CPU 85, sheet size information, a sheet discharge instruction signal, and a mode setting command of a post-processing mode and a print-out mode are transferred.

The post-processing control CPU 85 is provided with a sheet discharge operation control section 88, a stacking operation control section 89 that stacks sheets on the processing tray 15 by aligning them for each set, a binding processing control section 90, and a stacking control section 91.

(Description of Operation)

The control CPU 75 of the image formation device A described above executes an image formation operation to be described below in accordance with an image formation program stored in the ROM 76. Similarly, the post-processing control CPU 85 of the post-processing unit B described above executes post-processing operation to be described below in accordance with a post-processing program stored in the ROM 86.

(Image Formation Operation)

When a "single-sided print mode" is selected, the control CPU 75 discharges a sheet of a set size from the sheet feed section 2, and feeds the sheet to the sheet feed path 3. At almost the same time, the control CPU 75 forms an image in the print section 4 in accordance with predetermined image data. The image data is stored in a data storage section (not shown) or transferred from an external device connected to the image formation device A.

When a "double-sided print mode" is selected, the control CPU 75 executes the operation described above to form an image on a front surface side of a sheet, and then inverts the front and back of the sheet in a duplex path 7 provided continuously from the sheet discharge path 5 and feeds the sheet to the image formation section 4 again. After an image is formed on the back surface of the sheet, the control CPU 75 feeds the sheet to the sheet discharge path 5.

Next, the control CPU 85 of the post-processing device B carries a sheet sent to the main body sheet discharge port 6 into the carry-in port 12 of the sheet carrying path 11. At this time, the control CPU 85 rotates the carrying roller 14 in the carrying path in the sheet discharge direction upon receiving a sheet discharge instruction from the image formation device A.

The control unit (post-processing control CPU) 85 described above executes sheet discharge operation to be described below in accordance with a program implemented in the ROM 86 in accordance with a post-processing mode set by the image formation device A. The illustrated control unit includes the "first sheet discharge mode (print-out sheet discharge mode)" and the "second sheet discharge mode (post-processing sheet discharge mode)".

(Initial Operation)

Upon receiving a signal showing that sheet discharge is started from the control CPU 75 of the image formation device A, the control CPU 85 of the post-processing device B executes initial operation for receiving a sheet.

Figure 23:
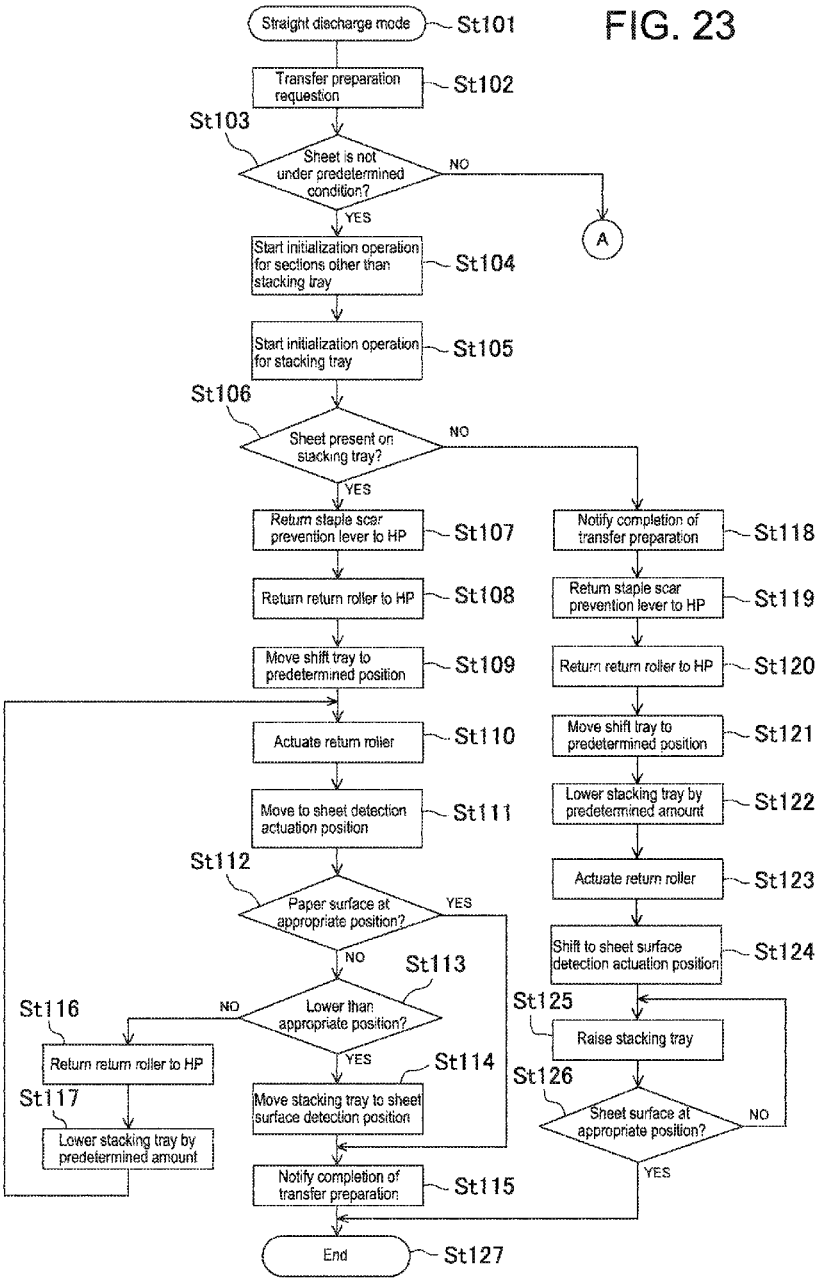
FIG. 23 is an operation flowchart (No. 1) that explains the initial operation of the stacking tray.
Figure 24:
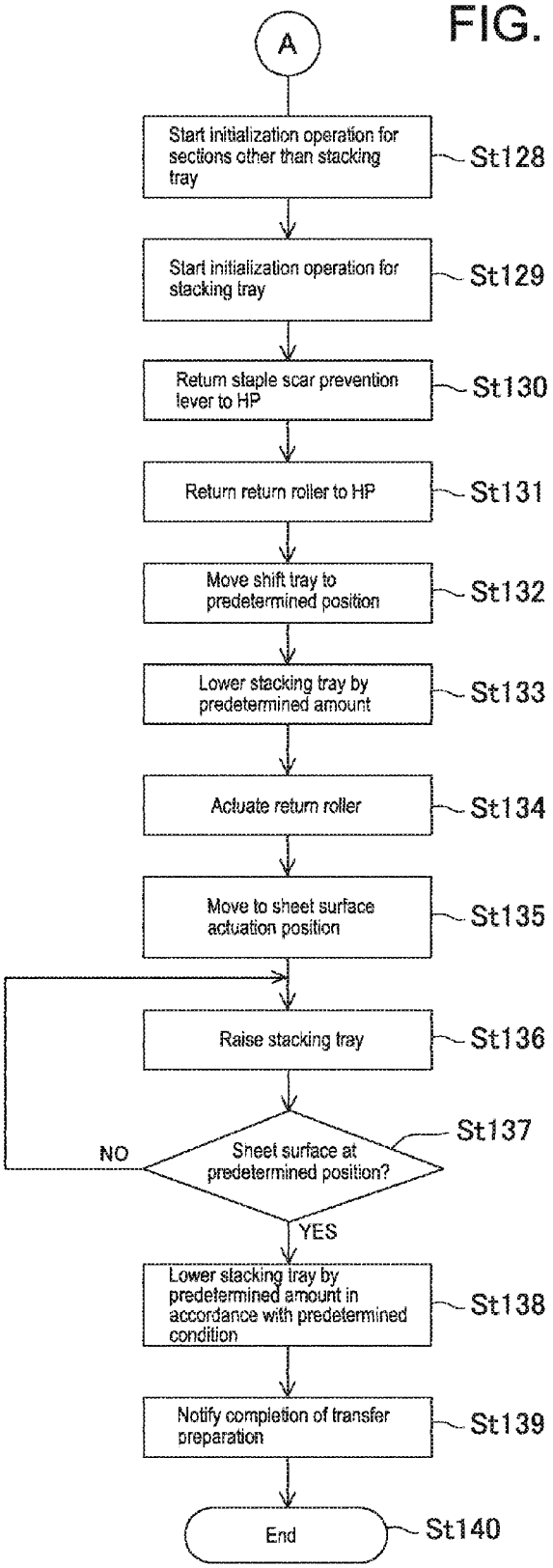
FIG. 24 is an operation flowchart (No. 2) that explains the initial operation of the stacking tray.

In the initial operation, mechanisms of the post-processing device B are moved to positions at which a sheet can be received. In particular, description will be given of initial operation of the stacking tray 40 with reference to operation flows of FIGS. 23 and 24.

First, information of a mode to be executed is received from the control CPU 75 of the image formation device A. When the mode information is the second sheet discharge mode which requires post processing, operational emphasis is put on alignment of sheets on the stacking tray 40. Although there is no difference in operation due to conditions, such as a sheet surface height, alignment is not greatly collapsed when the first sheet discharge mode is selected. Accordingly, the initial operation is differentiated in accordance with conditions, such as a sheet surface height, size and grammage of sheets, so that a time period required for the initial operation is reduced, and, at the same time, a noise generated in the initial operation is reduced. Hereinafter, description will be given of the initial operation according to each condition after the first sheet discharge mode is selected.

First, a transfer preparation request is received from the control CPU 75 of the image formation device A (St102). Next, a condition of a sheet is determined (St103), initializing operation of sections other than the stacking tray is started (St104), and initializing operation of the stacking tray is started (St105).

Figure 25:
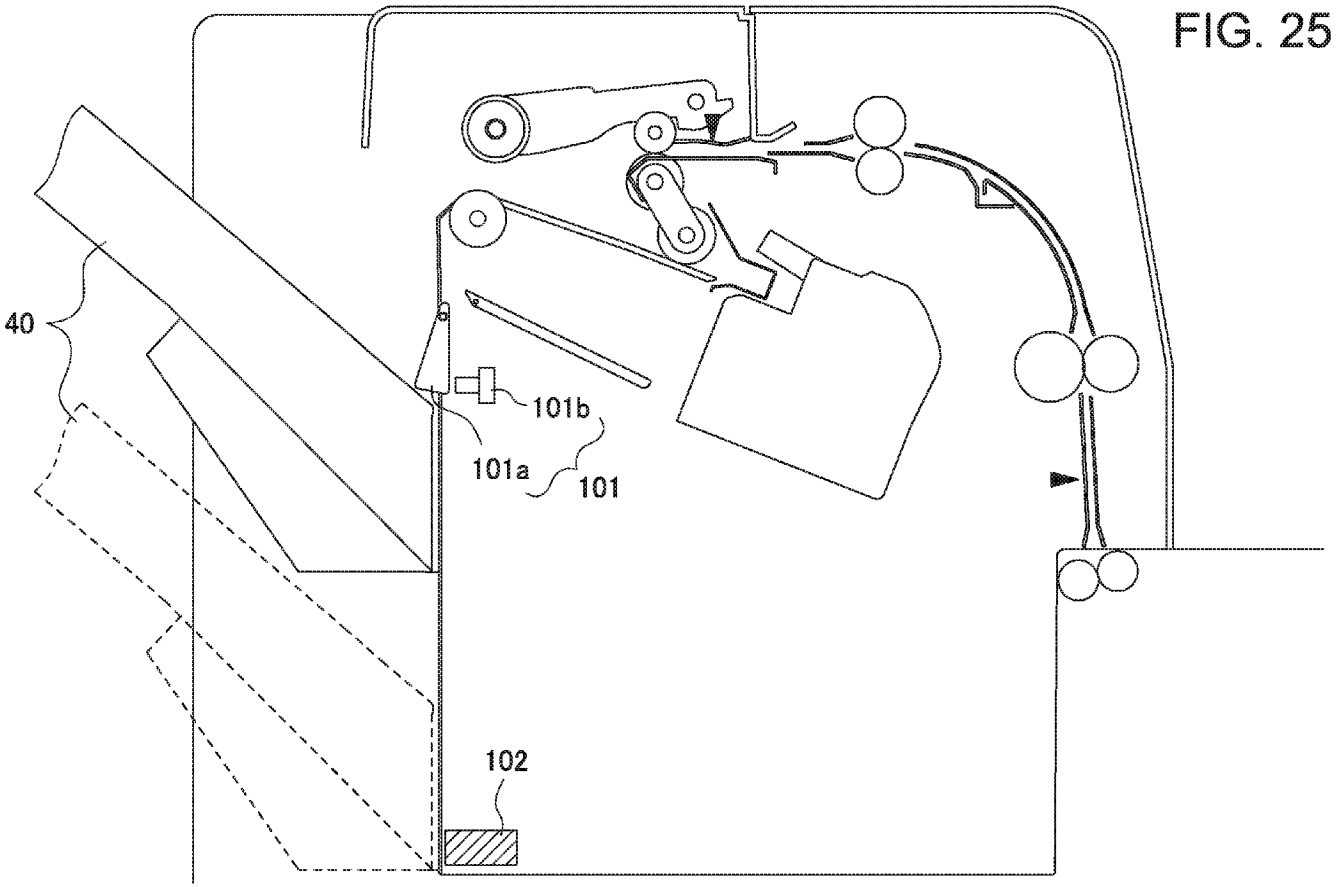
FIG. 25 is an explanatory view of a sheet presence/absence sensor and a stacking tray lower-limit sensor.
Figure 26:
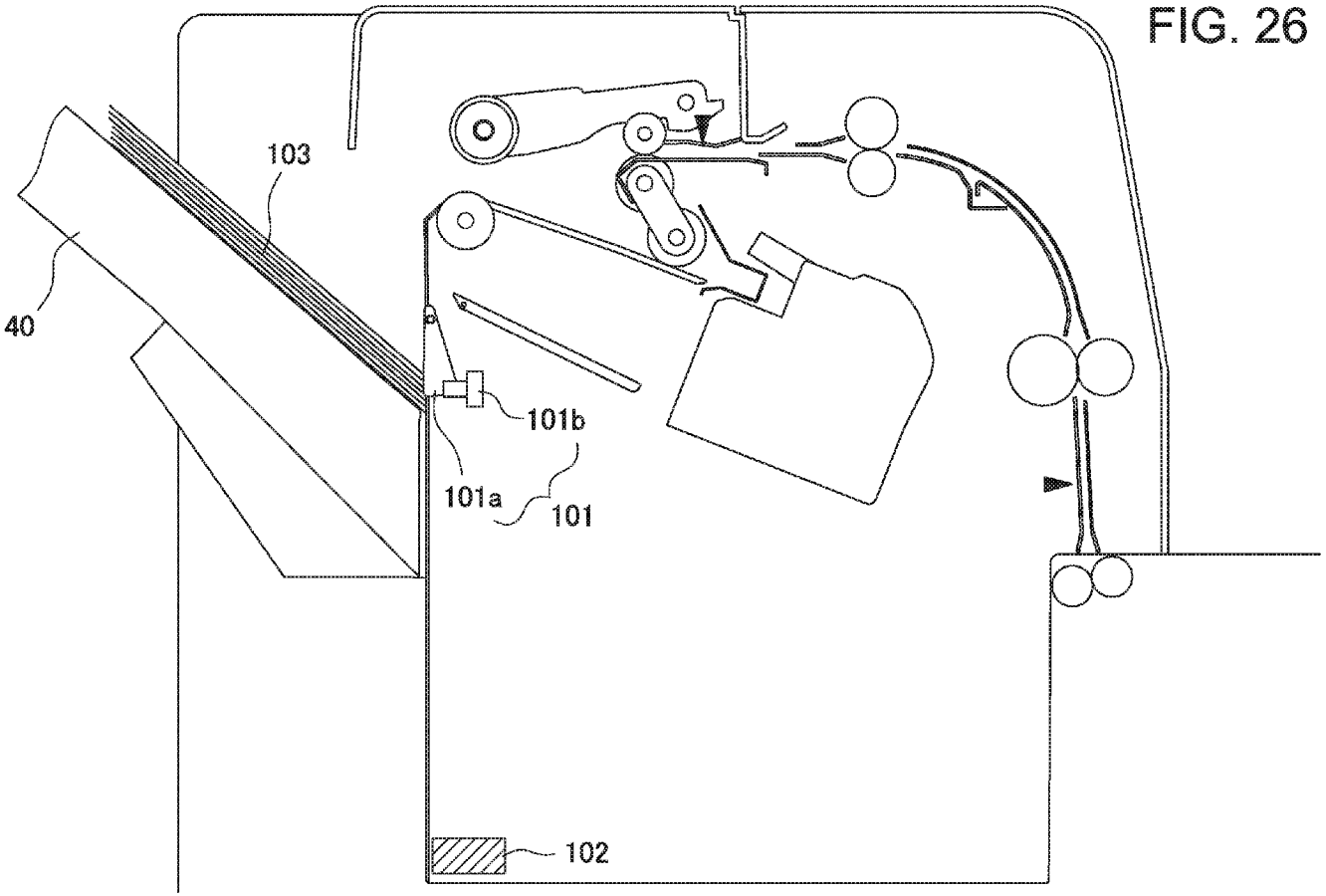
FIG. 26 is an explanatory view when the sheet presence/absence sensor is carrying out detection processing.

A sheet presence/absence detection unit 101 detects whether or not there is a sheet on the stacking tray 40 at the time the initial operation is started (St106). When a sheet is present on the stacking tray 40 as shown in FIGS. 25 and 26, a sheet end section presses in a sensor lever 101*a*. A sensor section 101*b* that is provided at the other end of the sensor lever 101*a* to detect a flag detects presence or absence of the sheet. When the sheet presence/absence detection unit 101 detects that "there is no sheet", a transfer preparation completion notification is sent to the control CPU 75 of the image formation device A (St118), and then the rear end support member 66, the return roller (inversion roller 20), and the jog shift motor GM are driven to move the fence plate 48 to a normal position (St119, St120, St121). After the stacking tray is temporarily moved to a lower limit position detected by a stacking tray lower limit sensor 102 (St122), operation of the sheet surface detection unit 55 is started (St123), the sheet surface detection unit 55 is positioned at an actuation position (St124), and the stacking tray is moved up (St125) so as to be positioned at the first storing height position H1 (St126). After that, the control CPU 85 of the post-processing device B is notified to start carrying of sheets (St127).

When a result of the detection performed by the sheet presence/absence detection unit 101 (St106) shows that there is a sheet, the rear end support member 66, the return roller (inversion roller 20), and the jog shift motor GM are driven to move the fence plate 48 to a normal position, and the initial operation is performed (St107, St108, St109).

Next, the sheet surface detection unit 55 is started operation (St110), positioned at an actuation position, and caused to detect a sheet surface height (Still) to determine whether or not a sheet surface height is at an appropriate position (St112). When the sheet surface is not at an appropriate position, the sheet surface detection unit 55 determines whether the sheet surface is low or high (St113). That is, the initial operation is differentiated in accordance with a sheet surface height.

(a) When a result of the sheet surface detection shows that the sheet surface is at an (I) appropriate height for straight sheet discharge (hereinafter referred to as the predetermined range) (when both fr1 and fr2 in FIG. 13 are sensed), completion of preparation for transfer to the (I) appropriate height for straight sheet discharge in FIG. 12A is notified without moving the stacking tray 40 (St115), and the initial operation is ended (St127).

(b) When a result of the sheet surface detection shows that the sheet surface is below the predetermined range (when fr1 is sensed and fr2 is not sensed in FIG. 12A), the stacking tray 40 is moved up (St114). When the sheet surface detection unit 55 is moved and fr2 is sensed, completion of preparation for transfer is notified to the control CPU 75 of the image formation device A (St115), and the initial operation is ended (St127).

(c) When a result of the sheet surface detection shows that the sheet surface is above the predetermined range (when fr1 is OFF and fr2 is ON in FIG. 12A), the sheet surface detection unit 55 is moved to the standby position (St116), then the stacking tray is moved down to a lower limit position detected by the lower limit sensor 102 (St117), and the sheet surface detection unit 55 is moved to the actuation position again (Still). After the above processing, the stacking tray 40 is moved up (St114). When fr1 and fr2 are ON, completion of preparation for transfer is notified to the control CPU 75 of the image formation device A (St115), and the initial operation is ended (St127). As described above, a retry operation, in which the sheet surface detection unit 55 is moved temporarily to the standby position and then moved to the actuation position again is performed.

The retry operation solves problems, such as that the sheet detection unit is caught and cannot track a sheet surface on the stacking tray by moving down the stacking tray when the sheet surface level on the stacking tray is high, and a detection position of the sheet surface detection unit is almost vertical to a swinging support, that is, the sheet surface detection unit cannot be sufficiently moved to the actuation position on the tray.

The retry operation is particularly effective by employing a configuration that uses the sheet surface detection unit 55 and the sheet pressure member 60 to be described later. When implementing a configuration of applying a pressure, a configuration for adjusting a pressure, a structure that withstands a pressing load as well as a swinging performance, a robust structure that supports the sheet surface detection unit becomes necessary. Even when frictional resistance is increased by swinging of the sheet surface detection unit under the influence of supporting the structure, reliable detection is ensured.

That is, even in a configuration where the sheet surface detection unit cannot easily swing to the actuation position and follow descending of the stacking tray, the stacking tray is positioned downward to create large space for swinging before the sheet surface detection unit is moved to the actuation position. In this manner, the sheet surface detection unit can swing downward significantly. Since the sheet surface detection unit is pressed up by a sheet surface of the ascending stacking tray and the sheet surface is positioned at an appropriate position, a precise detection can be achieved.

when subsequent discharged sheet information is received from the control CPU 75 of the image formation unit A, a sheet size detection sensor (not shown) or the like, and a discharged sheet satisfies a predetermined condition in which alignment property is easily lowered, operational emphasis is put on alignment property, not on curtailment of an initial operation time, and initial operation for receiving a sheet is executed at a position at which the sheet can reliably be discharged (St103). More specifically, there are three conditions as follows: (A) a sheet to be transferred has a length of 340 mm or larger, and is thick; (B) a sheet to be transferred has size of B5 vertically, and is light in weight; and (C) a sheet to be transferred is an envelope.

When the above conditions are satisfied, initialization operation of sections other than the stacking tray is started (St128), and then initialization operation of the stacking tray is started (St129).

The rear end support member 66, the return roller (inversion roller 20), and the jog shift motor GM are driven to move the fence plate 48 to a regular position (St130, St131, St132) to temporarily move the stacking tray to a lower limit position detected by the stacking tray lower limit sensor 102 (St133). After that, the sheet surface detection unit 55 is started operation (St134), and positioned at the actuation position (St135), and the stacking tray is moved up (St136) and positioned at the first storing height position H1 (St137).

The stacking tray is moved down in accordance with the sheet conditions (St138). This operation will be described in detail. In the above condition (A), the stacking tray is moved to a position 33.0 mm lower than the detected position within the predetermined range. This is because, when a length of a carried sheet is larger than or equal to 340.0 mm and the sheet is thick with a grammage of, for example, 99.0 $g/m^2$ or larger, there is a problem that a front end of the discharged sheet presses out a sheet which has already been stacked on the stacking tray 40, collapsing sheet alignment.

In the above condition (B), the stacking tray is moved to a position 4.37 mm lower than the detected position within the predetermined range. This is because, when the size of a transferred sheet is B5 vertically and the sheet is light in weight with a grammage of, for example, 64.0 $g/m^2$ or smaller, a problem occurs such that a front end of the sheet is curled and rolls when the sheet is discharged onto the stacking tray 40.

When an envelope is transferred as described in (C) above, the stacking tray is moved down by 65.8 mm from the detected position within the predetermined range. The stacking tray is moved down significantly in order to prevent the envelope from pressing out a sheet which has already been stacked on the stacking tray since rigidity of envelopes is high.

That is, when any of the above conditions 1 to 3 is satisfied, the sheet surface detection unit 55 is moved to the standby position, then moved down to a lower limit position detected by the stacking tray lower limit sensor 102, and the sheet surface detection unit 55 is moved to the actuation position again, independent of a result of the detection performed by the sheet surface detection unit 55. After that, the stacking tray 40 is moved up, and when fr1 and fr2 become ON, a sheet surface is adjusted to a height appropriate for discharge of each sheet from the predetermined range. Completion of preparation for transfer is notified to the control CPU 75 of the image formation unit A (St139), and the initial operation is ended (St140). That is, like the case when a result of the detection of sheet surface shows high, a sheet surface is moved up from a lower limit position and the initial operation is performed. After that, the sheet surface is adjusted to a height appropriate for each sheet from the predetermined range, and a sheet is received at an appropriate position. In this manner, alignment performance is improved.

In the "first sheet discharge mode", a sheet sent to the carry-in port 12 is discharged from the sheet carrying path 11 to and stored on the stacking tray 40 that is positioned at an appropriate height level by the initial operation. That is, a sheet sent from the sheet carrying path 11 is directly dropped and stored on the stacking tray 40 without transferring the sheet from the sheet discharge port 13 to the processing tray 15 by the inversion rollers 21 and 22. The first sheet discharge mode selectively executes the straight sheet discharge operation and the jog sheet discharge operation.

In the "jog sheet discharge operation", sheets sent to the carry-in port 12 are discharged from the sheet carrying path 11 to the stacking tray 40 in a manner that the sheets are sorted and aligned for each set. When this mode is executed, the jog shift motor GM described above is actuated, and the sheet placing tray 42 is moved by the cam member 50 in a manner integral with the fence plate 48 in the sheet width direction by a predetermined amount. In this manner, a series of sheets are aligned for each set and stacked on the sheet placing tray 42 in the width direction. The control unit 85 returns the sheet placing tray 42 to the initial position upon receiving a jog end signal from the image formation device A. Next, upon receiving an image formation signal and a sheet discharge instruction signal for a subsequent sheet, the control unit 85 moves the sheet placing tray 42 in an opposite direction by a predetermined amount.

In the "second sheet discharge mode", sheets sent to the carry-in port 12 are discharged from the sheet carrying path 11 and stacked on the processing tray 15 for binding processing, and then on the stacking tray 40 after binding processing. Sheet discharge operation in this mode is as described above.

(Sheet Discharge Operation)

Figure 20A:
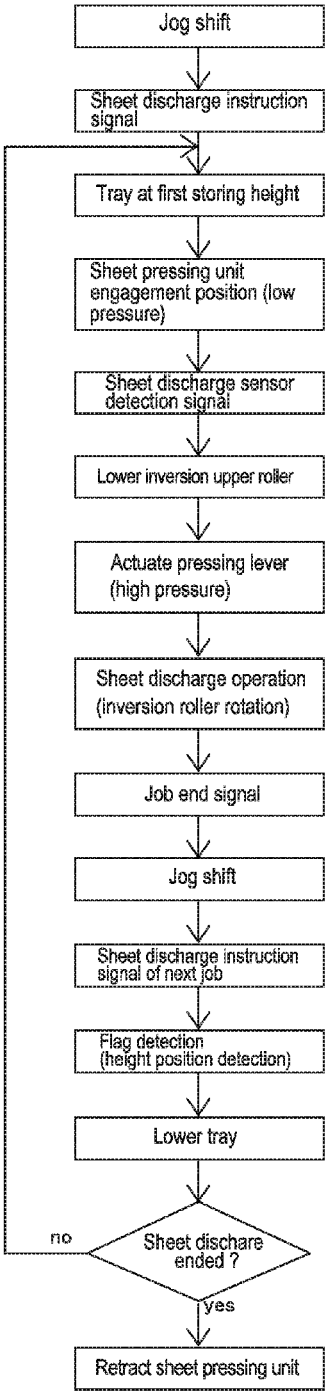
Figure 20B:
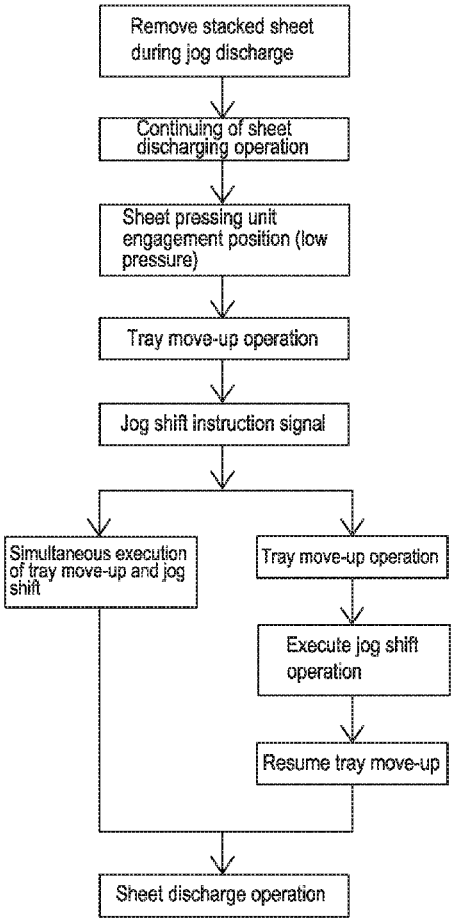

FIGS. 20A and 20B show flows of the jog sheet discharge operation. The sheet pressing unit 56 described above rakes sheets dropped from the sheet discharge port 13 located above along the rear end regulation surface 48*f* with the frictional rotator 19 in a state where the sheet pressing unit 56 is in engagement with and presses a top sheet on the sheet placing tray 42 (first embodiment). Alternatively, a sheet is dropped from the sheet discharge port 13 and stored in a state where the sheet pressing unit is left in a standby state at the standby position outside the tray, and the sheet pressing unit 56 is brought into engagement with a top sheet to press the sheet during the interval of carrying in a subsequent sheet, and, at the same time, a height is detected (second embodiment). Either of the above operation processes is selected and executed.

FIGS. 20A and 20B show sheet pressing control in which a sheet is dropped from the sheet discharge port 13 onto a frictional rotator of the sheet pressing unit 56 described above and stored in a state where the sheet pressing unit 56 is in engagement with a top sheet on the processing tray 15.

When jog sheet discharge operation is set in the image formation device A, the control unit 85 of the post-processing device B causes the sheet placing tray 42 to offset-move to a jog position set in advance. In this movement, the jog shift motor GM is rotated by a predetermined amount, and the sheet placing tray 42 and the fence plate 48 are moved in the sheet width direction by the cam member 50.

Next, the control unit 85 causes the sheet placing tray 42 to move to the first storing height position H1. The tray height is controlled by a rotation amount of the hoist motor MM based a height position of the sheet pressing unit 56 that is detected by the first to third sensors LSe1 to LSe3.

The control unit 85 causes the sheet pressing unit 56 to move from the standby position outside the tray to the actuation position in the tray after the tray height position is set. The operation is performed by adjusting a rotational angle of the sheet pressing motor KM described above and with the first to third sensors LSe1 to LSe3 that detect positions of the flags fr1, fr2, and fr3. For the sheet pressing unit 56 set to the first storing height position H1, as shown in FIG. 13B, a pressing force of the frictional rotator 60 for pressing a stacked sheet surface is set to a pressing force lower than that shown in FIG. 13C in which the unit 56 is set to the second storing height position H2. That is, in the illustrated configuration, the former shows a state where the pressing spring 62 does not function, and the latter shows a state where the pressing spring 62 functions.

Next, when the sheet discharge sensor Se2 detects a front end of a sheet, the inversion roller 20 is moved from the standby position Wp to the actuation position Ap after a predetermined period of time. At this time, the up/down motion lever 30 is shifted to a pressing position by the up/down drive motor SM. The inversion roller 20 presses the upper roller 21 against the lower roller 22 with a high pressing force, and the large-diameter roller body 21*a* and the small-diameter roller body 21*b* are pressed against the lower roller 22. When, in this state, the upper roller 21 is rotated in the sheet discharge direction, a sheet is discharged from the sheet discharge port 13 to the sheet placing tray 42.

Next, upon receiving a job end signal from the image formation device A, the control unit 85 rotates the jog shift motor GM in a direction opposite the above direction. Then, the sheet placing tray 42 returns to a predetermined initial position. When a sheet discharge instruction signal for the next job is issued, a tray height is detected by the first to third sensors Lse based on flag positions of the sheet pressing unit 56. Incidentally, the sheet pressing unit 56 is returned from the detection position to the standby position by the job end signal.

The subsequent sheet is stored in a state where the sheet is offset from the preceding sheet by a predetermined amount in a direction orthogonal to the sheet discharge direction, and sorted into sets. In a process of the sheet discharge operation, a sheet on the sheet placing tray 42 may be removed casually by an operator.

FIG. 20B shows operation in which a sheet on the tray is casually removed. The control unit 85 continues the sheet discharge operation irrespective of casual removal of a sheet. A tray height is detected at a predetermined timing. When the tray sheet surface is determined to be lower than a predetermined height position in the detection operation, the control unit drives the hoist motor MM to move the tray 4 to a predetermined height position.

Upon receiving a jog shift instruction signal from the image formation device A while the tray is being moved up, the control unit 85 stops the move-up operation of the tray, or moves the sheet placing tray 42 to a predetermined offset position in parallel with the tray move-up operation. The control unit 85 resumes the move-up operation of the tray after the sheet placing tray 42 is moved to a predetermined offset position.

Figure 21:
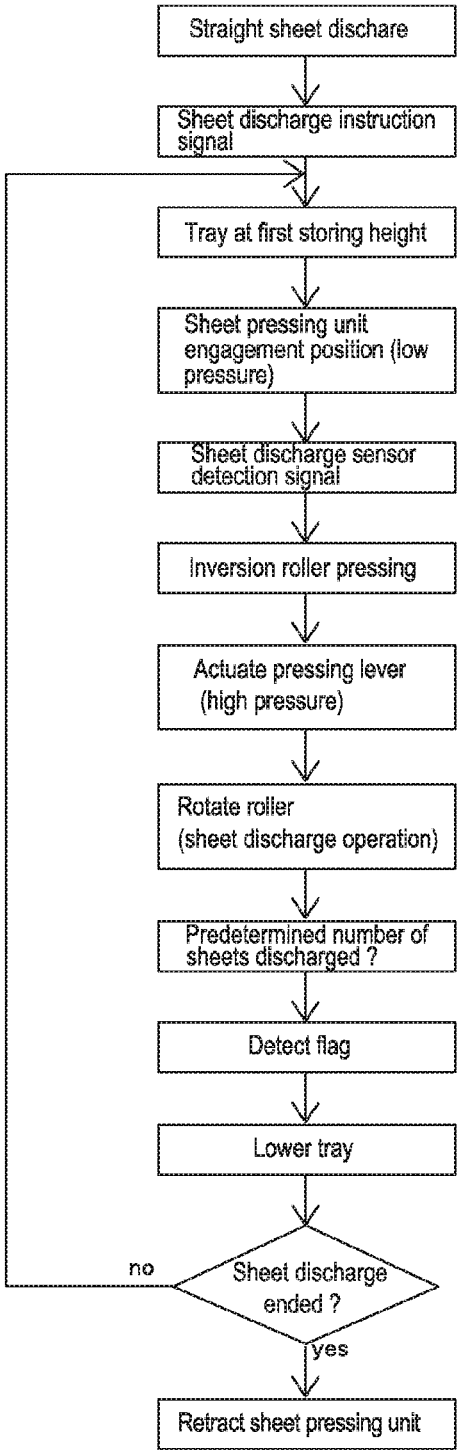
FIG. 21 is an explanatory view of an operation flow when a sheet bundle is removed from the tray while the jog sheet discharge is being carried out in the sheet discharge mode for storing sheets sent to the sheet discharge path one sheet at a time on the stacking tray.

Next, description will be given of operation performed when the straight sheet discharge operation is selected in the first sheet discharge mode in a post-processing mode selection step of the image formation device A in accordance with FIG. 21. Upon receiving a sheet discharge instruction signal from the image formation device A, the control unit 85 of the post-processing device B shifts a height of a surface of a top sheet of the sheet placing tray 42 to the first storing height position H1. After the tray move-up operation, the control unit 85 causes the sheet pressing unit 56 to shift from the standby state to the low pressure state. With reference to a signal issued by the sheet discharge sensor Se2 detecting a front end of a sheet, the control unit 85 controls the inversion roller 20 to shift from a set-off state to a pressing state. In this operation, the upper roller 21 is moved down to the lower roller 22 and both of the rollers are pressed against each other at a timing at which the front end of the sheet reaches a roller position. The roller pressing force at this time is set to a high pressing force, and the sheet sent to the sheet discharge port 13 is nipped between the upper roller 21 and the lower roller 22 and discharged to the sheet placing tray 42 on a downstream side.

At the same time, the control unit 85 rotates the frictional rotator 60 of the sheet pressing unit 56 in a predetermined direction (clockwise direction in FIG. 2). In this operation, a sheet is carried from the sheet discharge port 13 to the stacking tray 40, and is dropped on the sheet placing tray 42 after a rear end of the sheet passes through the sheet discharge port 13. A front end of the sheet is supported on a top sheet stacked on the sheet placing tray 42 and a rear end of the sheet is dropped on the frictional rotator 60. At this time, the frictional rotator 60 is rotated in the counter-clockwise direction in FIG. 2, and a rear end side of the sheet is raked onto a stacked sheet along a peripheral surface of the roller, and placed on the stacked sheet. A rear end edge of the sheet abuts on the rear end regulation surface 48*f* so as to be aligned.

When the above operation is continued, and sheets are stored on the stacking tray as many times as set in advance, the control unit 85 detects a height position of the sheet pressing unit 56. Then, the sheet placing tray 42 is lowered by a predetermined amount in accordance with the detected height position. When a job end signal is obtained from the image formation device A after the above operation, the sheet pressing unit 56 is retracted to the standby position and the processing is ended.

(Stapling)

Figure 22:
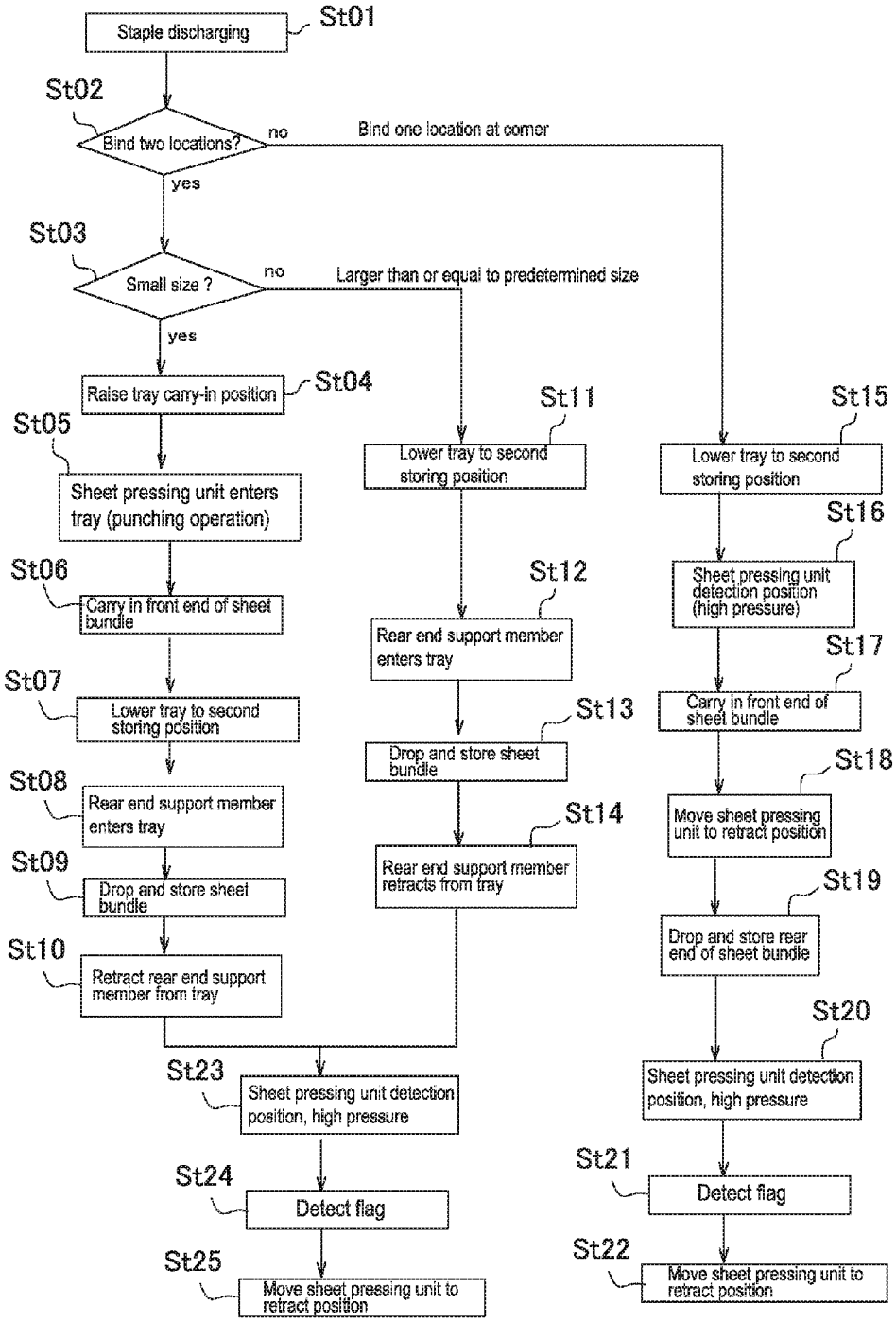
FIG. 22 is an explanatory view of an operation state of a staple sheet discharge mode in which delivered sheets are aligned for each set, stacked, and stapled in the sheet discharge mode in which sheets sent to the sheet discharge path are stored one sheet at a time on the stacking tray.

Next, description will be given of operation performed when the second sheet discharge mode is selected in the post-processing selection step of the image formation device A in accordance with FIG. 22. When stapling is selected as the post-processing mode in the image formation device A (St01), the illustrated device is configured to select and execute either "binding two locations in center" or "binding one location in corner" (St02).

(Binding Two Locations in Center)

The staple unit 17 (post-processing unit; the same applies hereinafter) described above is mounted on the device frame so as to be movable to an end edge of the processing tray 15 (tray unit; the same applies hereinafter) in the sheet width direction. The unit is connected to a staple shift motor (not shown). A single staple unit is moved to execute first binding operation and second binding operation in this order at equal intervals with reference to a sheet center. Hereinafter, the above operation will be referred to simply as the binding operation.

In this connection, upon receiving a job end signal from the image formation device A, the control unit 85 transmits a binding processing command to the staple unit 17 after aligning width of a sheet bundle on the processing tray 15. Upon receiving the signal, the staple unit 17 applies binding processing to a sheet bundle on the processing tray.

Next, upon receiving a processing end signal from the staple unit 17, the control unit 85 discharges a sheet bundle on the processing tray 15 to the stacking tray 40 on a downstream side. Before this operation is executed, the control unit 85 compares a length in the sheet discharge direction (size) of the sheet bundle (St03). This comparison is done to determine whether the height position of the tray is set to the second storing height position H2 or a position higher than the second storing height position H2 (the first storing height position H1 in the illustrated device).

That is, for a sheet bundle having a length larger than a predetermined length with reference to a length in the sheet discharge direction of a sheet bundle, the illustrated device sets the tray height to the second storing height position H2 and executes sheet discharge operation from the start to the end of sheet discharge. For a sheet bundle having a length smaller than or equal to a predetermined length, the device sets the tray height to the first storing height position H1 in an initial stage of sheet discharge, and sets the tray height to the second storing height position H2 when the sheet discharge is ended. The setting is so made in order to prevent a sheet having a small length from falling off before being stored when an attempt is made to drop the sheet onto the tray located away at a large distance from the falling sheet.

(When Size is Smaller than or Equal to Predetermined Size)

When the length in the sheet discharge direction of a sheet bundle for which binding processing has been performed on the processing tray 15 is smaller than or equal to a predetermined size, the control unit 85 sets a tray height set to the second storing height position H2 in two height levels, the first storing height position H1 and then the second storing height position H2, in accordance with discharge of sheets. The control unit 85 controls the sheet placing tray 42 to position at the first storing height described above upon receiving a processing end signal of the staple unit 17 (St04).

Next, immediately after raising the tray to the first storing height position H1, the control unit 85 swings the sheet pressing unit 56 described above from the standby position to the detection position above the tray by a predetermined angle (St05; punching operation). In this operation, the sheet pressing unit 56 is moved from the standby position to the detection position, from the state of FIG. 13A to the state of FIG. 13B, so that an end edge of a sheet stacked on the tray is punched by the sheet pressing unit 56 (the frictional rotator 60 in the diagram), and a rear end section of the sheet is pushed out from a regulation surface to the tray side. In this manner, a sheet end edge is prevented from being caught by the rear end regulation surface 48*f* during the move-up operation of the tray.

The punching operation described above does not need to be executed for all sheet sizes for which the sheet placing tray 42 is moved down in a stepwise manner. The operation is necessary for a predetermined size, such as a comparatively minimum size like a strip-shaped sheet size.

As described above, when a length in the transfer direction of a sheet bundle to be transferred from the processing tray 15 to the stacking tray 40 is smaller than or equal to a predetermined size, the control unit 85 controls the stacking tray to be lowered to two height levels, to the first storing height position H1 and then to the second storing height position H2, in accordance with a discharge timing of a sheet (St06, St07).

Next, after setting the height of the sheet placing tray 42 to the second storing height position H2, the control unit 85 allows the rear end support member 66 to enter above the sheet placing tray 42 from the standby position (St08). Next, when a sheet bundle is dropped on the rear end support member 66, the rear end support member 66 is inclined from the first angular posture to the second angular posture (St09). Next, the control unit 85 retracts the rear end support member 66 from the actuation position on the tray to the standby position outside the tray (St10). In this manner, a sheet bundle dropped from the sheet discharge port 13 is stored on a top sheet of the sheet placing tray 42.

Next, the control unit 85 moves the sheet pressing unit 56 from the standby position onto a top sheet on the sheet placing tray 42. A pressing force at this time is set to a high pressing force, and the frictional rotator 60 of the sheet pressing unit presses a sheet bundle with a high pressing force (St23). The control unit 85 detects a height position of the sheet pressing unit 56 with reference to the first to third flags fr1 to fr3 and the first to third sensors LSe1 to LSe3 (St24). After the height position detection, the control unit 85 moves the sheet pressing unit 56 to the standby position (St25), and at almost the same time, the control unit 85 causes the sheet placing tray 42 to lower by a predetermined amount.

(When Size is Larger than or Equal to Predetermined Size)

When a length in the sheet discharge direction of a sheet bundle for which the binding processing has been performed on the processing tray 15 is larger than or equal to a predetermined size, the control unit 85 sets the height of the sheet placing tray 42 to the second storing height position H2 (St11). After the tray height is set, the control unit 85 causes the rear end support member 66 to enter above the sheet placing tray 42 from the standby position (St12). Next, when the sheet bundle is dropped on the rear end support member 66, the rear end support member 66 is inclined to the second angular posture from the first angular posture (St13). Then, the control unit 85 causes the rear end support member 66 to retract from the actuation position on the tray to the standby position outside the tray (St14). In this manner, the sheet bundle dropped from the sheet discharge port 13 is stored on a top sheet of the sheet placing tray 42.

Next, the control unit 85 causes the sheet pressing unit 56 to move from the standby position onto a top sheet on the sheet placing tray 42. The pressing force at this time is set to a high pressing force, and the frictional rotator 60 of the sheet pressing unit presses a sheet bundle with a high pressing force (St23). The control unit 85 detects a height position of the sheet pressing unit 56 with reference to the first to third flags fr1 to fr3 and the first to third sensors LSe1 to LSe3 (St24). After the height position is detected, the control unit 85 causes the sheet pressing unit 56 to move to the standby position (St25), and, almost at the same time, the control unit 85 causes the sheet placing tray 42 to lower by a predetermined amount.

(Binding One Location at Corner)

When a mode setting signal from the image formation device A designates the second sheet discharge mode and operation of binding one location at a corner, the control unit 85 executes operation to be described below.

Upon receiving a job end signal from the image formation device A, the control unit 85 aligns width of a sheet bundle on the processing tray 15, and then moves the staple unit 17 to a binding position (sheet corner), and controls the staple unit 17 to execute staple operation. Upon receiving a processing end signal from the unit, the control unit 85 discharges the sheet bundle on the processing tray 15 to the stacking tray 40 on a downstream side.

Prior to the discharge operation of a sheet bundle, the control unit 85 moves the sheet placing tray 42 to the second storing height position H2 (St15). The control unit moves the sheet pressing unit 56 from the standby position onto a top sheet on the tray (detection position). The pressing force at this time is set to a high pressing force, and no rotational force is provided to the frictional rotator 60 (St16).

Next, the control unit 85 rotates the inversion roller in the sheet discharge direction to discharge a sheet bundle in a manner sliding a front end of the sheet bundle onto a top sheet on the tray (St17). A sheet layer (stored sheet bundle) stacked on the tray at this time is pressed by the sheet pressing unit 56. Accordingly, a stacked sheet is not moved by a carrying force of a sheet carried in from the sheet discharge port 13. In particular, when a sheet bundle whose corner is bound is present on the sheet placing tray, and a sheet bundle is pushed out from the processing tray 15 onto the corner-bound sheet bundle with a high friction engagement force, an end section of a staple is sometimes torn off. This problem is, however, not generated since a top sheet bundle at this time is pressed and supported by the sheet pressing unit 56 (St20).

Next, the control unit 85 detects a height position of the sheet pressing unit 56 with the first to third flags fr1 to fr3 and the first to third sensors LSe1 to LSe3 (St21). After the height position is detected, the control unit 85 moves the sheet pressing unit 56 to the standby position (St22), and, almost at the same time, the control unit 85 moves down the sheet placing tray 42 by a predetermined amount.

As described above in detail, the sheet stacking device according to the present invention includes the stacking tray 40 on which discharged sheets are stacked, an elevation unit E that raises and lowers the stacking tray 40, the sheet surface detection unit 55 that detects a sheet surface height of a top sheet stacked on the stacking tray 40, and the control unit 85 that controls the elevation unit E based on a result of the detection performed by the sheet surface detection unit 55. The control unit 85 executes the initial operation for moving the stacking tray 40 within a predetermined range set in advance before a sheet is discharged onto the stacking tray 40.

(a) When the sheet surface height is within the predetermined range, the initial operation is ended without further operation. (b) When the sheet surface height is positioned below the predetermined range, the elevation unit 30 and the like are moved up, and the initial operation is ended at a time point at which the sheet surface height enters the predetermined range. (c) When the sheet surface height is above the predetermined range, the elevation unit 30 and the like are temporarily lowered to shift the sheet surface height to be below the predetermined range, and then the elevation unit E is raised to shift the sheet surface height to be within the predetermined range.

What is claimed is:

1. A sheet stacking device, comprising:

a stacking tray for stacking a discharged sheet;

an elevation unit that raises and lowers the stacking tray;

a sheet presence or absence detection unit that detects presence or absence of a sheet on the stacking tray, a sheet surface detection unit that detects a sheet surface height of a top sheet stacked on the stacking tray; and a control unit that controls the elevation unit based on a result of detection performed by the sheet surface detection unit, wherein the control unit executes initial operation for moving the stacking tray to a predetermined range set in advance before a sheet is discharged onto the stacking tray, and when the sheet presence or absence detection unit detects presence or absence of a sheet on the stacking tray, and (a) when the sheet surface height is within the predetermined range, the initial operation is ended without further operation, (b) when the sheet surface height is below the predetermined range, the initial operation is ended at a time point at which the elevation unit is raised and the sheet surface height enters the predetermined range, and (c) when the sheet surface height is above the predetermined range, the elevation unit is temporarily lowered to shift the sheet surface height to be below the predetermined range, and then the elevation unit is raised to shift the sheet surface height to be within the predetermined range.

2. The sheet stacking device according to claim 1, wherein in the initial operation, when a result of detection performed by the sheet or absence detection unit shows that there is no sheet, the control unit causes the elevation unit to temporarily lower irrespective of a result of the detection performed by the sheet surface detection unit to shift the sheet surface height to be below the predetermined range, and then causes the elevation unit to rise to shift the sheet surface height to be within the predetermined range.

3. The sheet stacking device according to claim 2, wherein the sheet surface detection unit has a configuration capable of being projected onto and retracted from the stacking tray, and at the time the initial operation is performed, when the sheet surface height is determined, by the sheet surface detection unit, to be above the predetermined range, the control unit causes the sheet surface detection unit to temporarily retract from the stacking tray, and then causes the elevation unit to lower to move the stacking tray below the predetermined range, and then causes the sheet surface detection unit to perform a sheet surface detection again.

4. The sheet stacking device according to claim 1, wherein the stacking tray includes an inclined surface on which an end section of a discharged sheet abuts so as to be aligned.

5. The sheet stacking device according to claim 1, wherein the sheet surface detection unit includes a rotation mechanism to be projected onto and retracted from the stacking tray, and a pressing mechanism that presses a sheet on the stacking tray.

6. A post-processing device comprising the sheet stacking device according to claim 1, the post-processing device stacking sheets by aligning the sheets for each set in a bundle and performing binding processing, or sending out discharged sheets onto the stacking tray without further operation.

7. An image formation system comprising the post-processing device according to claim 6, the image formation system discharging a sheet on which an image is formed to the post-processing device.

* * * * *